US009417539B2

(12) United States Patent
Inagaki et al.

(10) Patent No.: US 9,417,539 B2
(45) Date of Patent: Aug. 16, 2016

(54) ORGANIC PHOTORECEPTOR, IMAGE FORMING APPARATUS, AND IMAGE FORMING METHOD

(71) Applicant: Konica Minolta, Inc., Tokyo (JP)

(72) Inventors: Keiichi Inagaki, Hino (JP); Toshiyuki Fujita, Hachioji (JP); Mari Konishi, Hino (JP); Masanori Yumita, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/541,678

(22) Filed: Nov. 14, 2014

(65) Prior Publication Data

US 2015/0160573 A1 Jun. 11, 2015

(30) Foreign Application Priority Data

Dec. 11, 2013 (JP) ..... 2013-255809

(51) Int. Cl.
*G03G 5/147* (2006.01)

(52) U.S. Cl.
CPC ..... *G03G 5/14704* (2013.01); *G03G 5/1476* (2013.01); *G03G 5/14708* (2013.01); *G03G 5/14791* (2013.01)

(58) Field of Classification Search
CPC ..... G03G 5/0614
See application file for complete search history.

(56) References Cited

U.S. PATENT DOCUMENTS

| | | | | |
|---|---|---|---|---|
| 2007/0148570 | A1* | 6/2007 | Iwasaki | G03G 5/0614 430/58.75 |
| 2009/0196658 | A1 | 8/2009 | Sugiura | |
| 2011/0033204 | A1 | 2/2011 | Fujita et al. | |

FOREIGN PATENT DOCUMENTS

| | | |
|---|---|---|
| JP | 2006-011014 | 1/2006 |
| JP | 2008-046198 A | 2/2008 |
| JP | 2010-107962 | 5/2010 |
| JP | 2011-175140 | 9/2011 |
| JP | 2012-042777 | 3/2012 |
| JP | 2013-061625 | 4/2013 |
| WO | WO2010/018725 A1 | 2/2010 |

* cited by examiner

*Primary Examiner* — Peter Vajda
(74) *Attorney, Agent, or Firm* — Lucas & Mercanti, LLP

(57) ABSTRACT

In an organic photoreceptor that has a protective layer formed on an organic photosensitive layer, the protective layer contains; a cured resin constituent obtained by polymerizing a polymerizable compound in the presence of a radical scavenger represented by the general formula (2); metal oxide microparticles; and a compound represented by the general formula (1) as a charge transport substance, and the relational expression (1): $80/A \leq B \leq 160/A$ and the relational expression (2): $12 \leq A \leq 25$ are satisfied when the volume ratio (volume %) of the metal oxide microparticles in the protective layer and the volume ratio (volume %) of the compound represented by the general formula (1) in the protective layer are respectively denoted by A and B.

15 Claims, 3 Drawing Sheets

ORGANIC PHOTORECEPTOR, IMAGE FORMING APPARATUS, AND IMAGE FORMING METHOD

The entire disclosure of Japanese Patent Application No. 2013-255809 filed on Dec. 11, 2013 including description, claims, drawings, and abstract are incorporated herein by reference in its entirety.

BACKGROUND OF THE INVENTION

1. Field of the Invention

The present invention relates to an organic photoreceptor (hereinafter, also referred to simply as "photoreceptor") for use in electrophotographic image formation, and an image forming apparatus including the organic photoreceptor, and an image forming method.

2. Description of the Related Art

Organic photoreceptors have been considered as the mainstream on behalf of inorganic photoreceptors, because the organic photoreceptors have advantages such as the expanded scope of material selection, excellent environment adaptability, and low production cost, as compared with inorganic photoreceptors like selenium photoreceptors and amorphous silicon photoreceptors.

In recent years, highly-durable photoreceptors have been desired in response to image forming apparatuses which have improved in speed and image quality.

In general, photoreceptors have a problem that the surfaces of the photoreceptors are abraded by contact with cleaning unit such as a blade. In order to suppress the abrasion of the photoreceptor surfaces, it is known that a protective layer is provided on the photoreceptor surfaces (see, for example, JP 2008-46198 A).

Conventionally, cured resins obtained by the polymerization of polymerizable compounds, which contain metal oxide microparticles surface-treated with a surface preparation agent having a reactive organic group, have been known as protective layers which are excellent in abrasion resistance and scratch resistance (see, for example, International Publication WO 2010/018725).

However, the protective layers from the cured resins containing the metal oxide microparticles have the problem of decreased dot reproducibility, because of diffusion caused during hole transfer at reduced electric field intensity. Furthermore, the protective layers from the cured resins containing the metal oxide microparticles are excellent in abrasion resistance, and thus able to have longer lifetime, but at the same time, have problems such as transfer memory generation and decreased dot reproducibility, due to the decrease in surface resistance under high-temperature and high-humidity environments, with discharge products deposited on the photoreceptor surfaces in the latter halves of the useful lives of the photoreceptors.

The method of adding a charge transport substance to the protective layer is conceivable in order to suppress the generation of transfer memory. However, as the additive amount of the charge transport substance is increased, the problem of decreased dot reproducibility is newly caused while the suppression effect of transfer memory generation is increased. Furthermore, as the additive amount of the charge transport substance is increased, the charge transport substance develops a function as a plasticizer, thereby causing a problem that the protective layer fails to have high film strength (scratch resistance).

SUMMARY OF THE INVENTION

The present invention has been achieved in view of the circumstances mentioned above, and an object of the present invention is to provide an organic photoreceptor which has scratch resistance, and has excellent memory tolerance and dot reproducibility even after use over a long period of time, an image forming apparatus including the organic photoreceptor, and an image forming method.

To achieve at least one of the abovementioned objects, according to an aspect, an organic photoreceptor reflecting one aspect of the present invention comprises an organic photosensitive layer formed on a conductive support, and comprises a protective layer formed on the organic photosensitive layer, the protective layer contains; a cured resin constituent obtained by polymerizing a polymerizable compound in the presence of a radical scavenger represented by the following general formula (2); metal oxide microparticles; and a compound represented by the following general formula (1) as a charge transport substance, and the following relational expression (1) and the following relational expression (2) are satisfied when the volume ratio (volume %) of the metal oxide microparticles in the protective layer and the volume ratio (volume %) of the compound represented by the general formula (1) in the protective layer are respectively denoted by A and B.

$$80/A \leq B \leq 160/A \quad \text{Relational Expression (1)}$$

$$12 \leq A \leq 25 \quad \text{Relational Expression (2)}$$

[Chemical Formula 1]

General Formula (1)

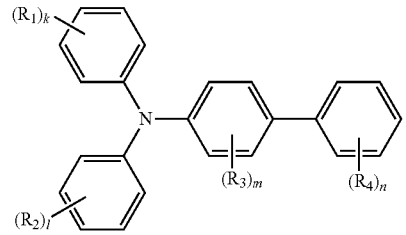

[In the general formula (1), $R_1$, $R_2$, $R_3$, and $R_4$ each represents a hydrogen atom, an alkyl group having 1 to 7 carbon atoms, and an alkoxy group having 1 to 7 carbon atoms. k, l, and n each represents an integer of 1 to 5, and m represents an integer of 1 to 4, provided that when k, l, n, or m is 2 or more, multiple $R_1$, $R_2$, $R_3$ and $R_4$ may be identical to each other, or different from each other.]

[Chemical Formula 2]

General Formula (2)

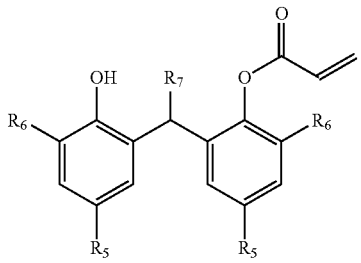

[In the general formula (2), $R_5$ and $R_6$ each represents an alkyl group having 1 to 6 carbon atoms, and $R_7$ represents a hydrogen atom or a methyl group.]

In the organic photoreceptor according to the present invention, in the general formula (1), preferably, $R_1$ and $R_2$ are each a hydrogen atom or a methyl group, $R_3$ is a hydrogen atom, $R_4$ is an alkyl group having 1 to 5 carbon atoms, and k, l, m, and n are each 1.

To achieve at least one of the abovementioned objects, according to an aspect, an image forming apparatus reflecting one aspect of the present invention comprises: an organic photoreceptor; a first charging unit for charging the surface of the organic photoreceptor; an exposure unit for irradiating the surface of the organic photoreceptor with light to form an electrostatic latent image; a development unit for developing the electrostatic latent image with a toner to form a toner image; a transfer unit for transferring the toner image to a transfer material; a second charging unit for charging the surface of the organic photoreceptor after transferring the toner image to the transfer material; and a cleaning unit for removing a residual toner on the organic photoreceptor, and the apparatus is characterized in that the organic photoreceptor is the organic photoreceptor described above.

To achieve at least one of the abovementioned objects, according to an aspect, an image forming method reflecting one aspect of the present invention is characterized in that the image forming apparatus described above is used for image formation.

BRIEF DESCRIPTION OF THE DRAWINGS

The above and other objects, advantages and features of the present invention will become more fully understood from the detailed description given herein below and the appended drawings which are given by way of illustration only, and thus are not intended as a definition of the limits of the present invention, and wherein.

DESCRIPTION OF THE PREFERRED EMBODIMENTS

Figure 1:
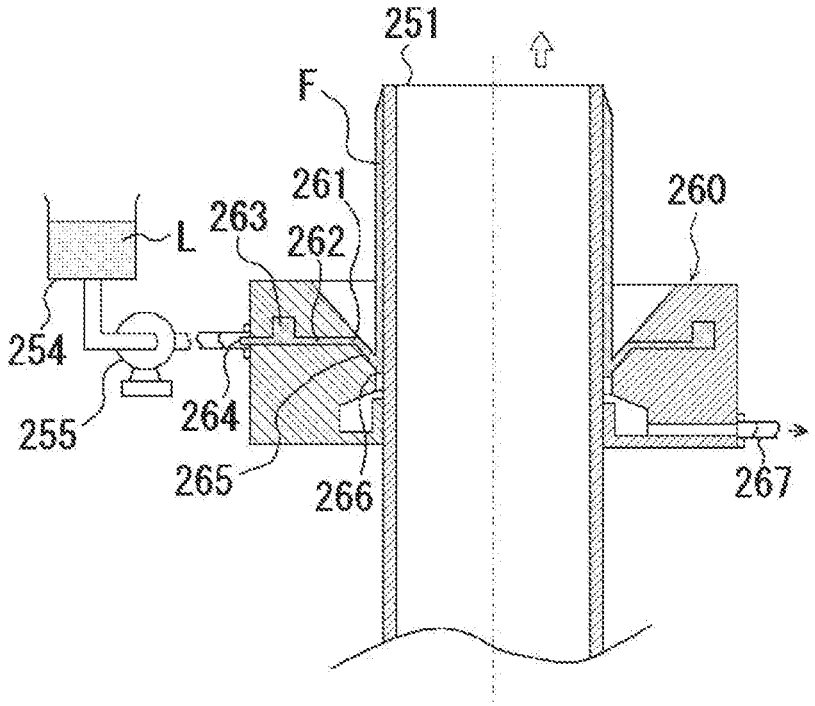
FIG. 1 is an explanatory cross-sectional view illustrating a configuration example of a circular slide hopper coating applicator for use in a method for producing an organic photoreceptor according to an embodiment of the present invention.
Figure 2:
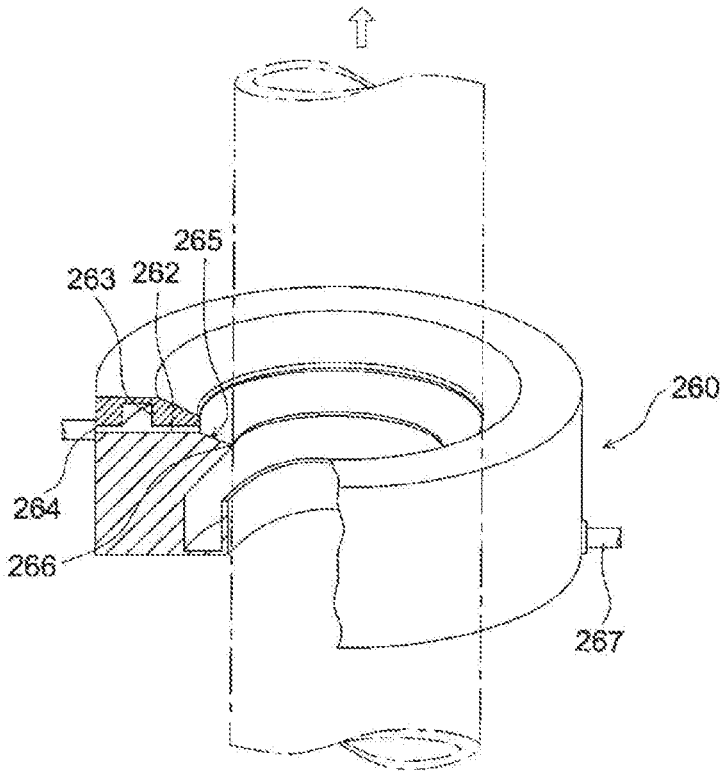
FIG. 2 is a perspective cross-sectional view of the circular slide hopper coating applicator shown in FIG. 1.

Hereinafter, an embodiment of the present invention will be described with reference to the drawings. However, the scope of the invention is not limited to the illustrated examples.

Hereinafter, the present invention will be described in detail.

[Organic Photoreceptor]

The photoreceptor according to the present invention has a layer configuration obtained by sequentially stacking, on a conductive support, an organic photosensitive layer composed of a charge generation layer and a charge transport layer, and a protective layer. In addition, the photoreceptor according to the present invention can be also configured to have an interlayer between the conductive support and the charge generation layer. Furthermore, the organic photosensitive layer may be a single layer containing a charge generation substance and a charge transport substance.

According to the present invention, the organic photoreceptor means an electrophotographic photoreceptor in which an organic compound has at least one of essential charge generation function and charge transport function to the composition of the electrophotographic photoreceptor, and encompasses known organic photoreceptors such as a photoreceptor composed of a known organic charge generation substance or organic charge transport substance and a photoreceptor with a charge generation function and a charge transport function constituted with a polymer complex.

[Protective Layer]

The protective layer constituting the photoreceptor according to the present invention is formed as a surface layer on the organic photosensitive layer. This protective layer contains a cured resin constituent obtained by polymerizing a polymerizable compound in the presence of a specific radical scavenger, metal oxide microparticles, and a specific charge transport substance, and the mixing ratio (volume ratio) between the metal oxide microparticles and the specific charge transport substance satisfies the relational expression (1) and the relational expression (2).

The photoreceptor according to the present invention, which includes the protective layer as described above, even after use over a long period of time, has scratch resistance and suppress the generation of transfer memory, and can form images which have excellent dot reproducibility. The reason that this advantageous effect is obtained will be specifically described below.

Conventionally, the protective layers containing the metal oxide microparticles have dot reproducibility decreased because of diffusion caused during hole transfer at reduced electric field intensity in the protective layers. Further, the increased additive amount of the charge transport substance in the protective layer with the decreased electric field intensity further increases hole diffusion, thereby significantly decreasing the dot reproducibility. Accordingly, there is a need to add an appropriate amount of charge transport substance, depending on the electric field intensity required. In addition, the electric field intensity depends on the additive amount of the metal oxide microparticles, and there is a tendency to reduce the electric field intensity when the amount is increased. More specifically, the relational expression (1) and relational expression (2) specified in the present invention are intended to empirically obtain the appropriate amount of the charge transport substance at the electric field intensity determined by the appropriate amount of the metal oxide microparticles. Furthermore, the metal oxide microparticles also has the function of improving the film strength (scratch resistance) due to the filler effect. Accordingly, according to the present invention, the relation in terms of volume ratio between the metal oxide microparticles and the specific charge transport substance is specified to provide excellent memory tolerance and dot reproducibility with scratch resistance even after use over a long period of time.

In addition, the protective layer containing the metal oxide microparticles has a surface resistance reduced by deposition of discharge products, etc., and thus makes the generation of transfer memory and the decrease in dot reproducibility more likely to be caused, and there is a need to constantly refresh the surface of the photoreceptor. In order to refresh the surface of the protective layer composed of the cured resin constituent, there is a need to form a protective layer with appropriate film strength (abrasion resistance), thereby making it possible to control the amount of wear and tear. In addition, even when there are differences in linear speed, external toner additive, etc., high image qualities and long service lives can be achieved by controlling the amount of wear and tear with accuracy. Thus, according to the present invention, the use of the specific radical scavenger in the polymerization reaction of the polymerizable compound can efficiently stop the cross-linking reaction, thus making it possible to control the crosslink density of the polymer (the film strength of the cured film), and adjust the amount of wear and tear with accuracy.

(Cured Resin Constituent)

The cured resin constituent constituting the protective layer is obtained by irradiating the polymerizable compound with actinic rays such as ultraviolet rays or electron beams in the presence of the specific radical scavenger to polymerize and cure the compound. As the polymerizable compound, a monomer having two or more polymerizable functional groups (multifunctional polymerizable compound) is used, and can be also used in combination with a monomer having a polymerizable functional group (monofunctional polymerizable compound). Specifically, examples of the polymerizable compound include, for example, a styrene monomer, an acrylic monomer, a methacrylic monomer, a vinyl toluene monomer, a vinyl acetate monomer, a N-vinylpyrrolidone monomer.

The polymerizable compound is particularly preferably an acrylic monomer or an oligomer thereof having two or more acryloyl groups ($CH_2{=}CHCO{-}$) or methacryloyl groups ($CH_2{=}CCH_3CO{-}$), because it is possible to cure the monomer or oligomer with a small amount of light or in a short period of time.

In the present invention, the polymerizable compound may be used by itself, or as a mixture. In addition, the polymerizable compound may be used as a monomer, but may be subjected to oligomerization and used.

Here are specific examples of the polymerizable compound.

[Chemical Formula 3]

M1

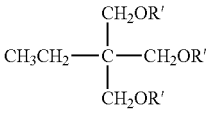

M2

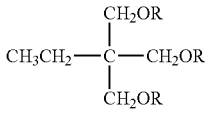

M3

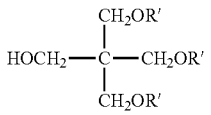

M4

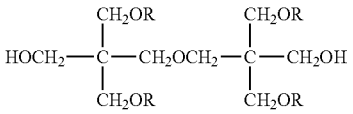

-continued

M5

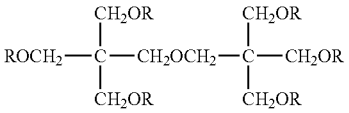

M6

$CH_3CH_2C{-}(CH_2OC_3H_6OR)_3$

M7

$CH_3CH_2C{-}(CH_2CH_2OR)_3$

[Chemical Formula 4]

M8

$R{-}(OC_3H_6)_3{-}OR$

M9

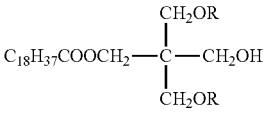

M10

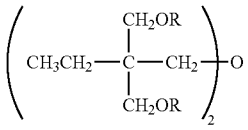

M11

$(ROCH_2)_4C$

M12

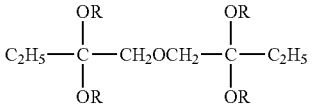

M13

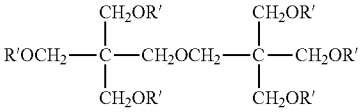

M14

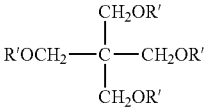

In the above chemical formulas representing the exemplary compounds (M1) to (M14), however, R represents an acryloyl group ($CH_2{=}CHCO{-}$), and R' represents a methacryloyl group ($CH_2{=}CCH_3CO{-}$).

It is preferable to use, as the polymerizable compound, a monomer having three or more polymerizable functional groups. In addition, while two or more compounds may be used in combination as the polymerizable compound, it is also preferable in this case to use a monomer having three or more polymerizable functional groups in a proportion of 50 mass % or more.

The polymerizable compound is polymerized in the presence of the specific radical scavenger. This specific radical scavenger functions as a sealant for cross-linking bonds. More specifically, the specific radical scavenger can adjust the crosslink density (the film strength of the cured film), depending on the proportion of the scavenger added or the like. Accordingly, according to the present invention, the cured resin constituent is obtained by polymerizing the polymerizable compound in the presence of the specific radical scavenger, and the protective layer is thus provided to have appropriate film strength (abrasion resistance), and the photoreceptor is provided to have a surface with appropriate wear and tear by cleaning unit such as a blade. Therefore, even when discharge products, etc. are deposited on the surface of the photoreceptor, the surface of the photoreceptor is refreshed by the wear and tear, and memory durability and dot reproducibility can be thus maintained.

The specific radical scavenger is a compound represented by the general formula (2), and in the general formula (2), $R_5$ and $R_6$ each represents an alkyl group having 1 to 6 carbon atoms, and $R_7$ represents a hydrogen atom or a methyl group. $R_5$ and $R_6$ are preferably a tert-butyl group or a tert-pentyl group from the perspective of stability of captured radicals. In addition, $R_7$ is preferably a methyl group.

(Metal Oxide Microparticle)

As the metal oxide microparticles constituting the protective layer, for example, silica (silicon oxide), magnesium oxide, zinc oxide, lead oxide, alumina (aluminum oxide), zirconium oxide, tin oxide, titania (titanium oxide), niobium oxide, molybdenum oxide, and vanadium oxide can be used, but above all, tin oxide is preferred from the perspective of electrical characteristics.

The metal oxide microparticles are not particularly limited, but particles can be used which are prepared by known production methods.

The metal oxide microparticles are preferably 1 nm to 300 nm, more preferably 3 to 100 nm, and further preferably 5 nm to 40 nm in number average primary particle size.

In the present invention, as for the number average primary particle size of the metal oxide microparticles, a magnified photograph at 10000-fold magnification was taken with a scanning electron microscope (from JEOL Ltd.), and from photographic images of 300 particles (excluding aggregated particles), which were captured through a scanner, an image processing analyzer "LUZEX AP (Software Version Ver. 1.32)" (from Nireco Corporation) was used to calculate the number average primary particle size.

The metal oxide microparticles may be surface-treated with a surface preparation agent having a reactive organic group (also referred to as a "reactive organic group-containing surface preparation agent"), Specifically, the metal oxide microparticles as a raw material (hereinafter, also referred to as "untreated metal oxide microparticles") is subjected to a surface preparation with the reactive organic group-containing surface preparation agent to introduce the reactive organic group onto the surfaces of the untreated metal oxide microparticles.

The reactive organic group-containing surface preparation agent preferably reacts with hydroxy groups and the like present on the surfaces of the metal oxide microparticles, and example of such a reactive organic group-containing surface preparation agent include, for example, a silane coupling agent and a titanium coupling agent.

In addition, the reactive organic group-containing surface preparation agent is preferably a surface preparation agent having a radical polymerizable reactive group. Examples of the radical polymerizable reactive group include a vinyl group, an acryloyl group, and a methacryloyl group. Such a radical polymerizable reactive group can also react with the polymerizable compound according to the present invention to forma strong protective layer. The surface preparation agent having a radical polymerizable reactive group is preferably a silane coupling agent having a radical polymerizable reactive group such as a vinyl group, an acryloyl group, or a methacryloyl group.

Here are specific examples of the reactive organic group-containing surface preparation agent.

S-1: $CH_2{=}CHSi(CH_3)(OCH_3)_2$
S-2: $CH_2{=}CHSi(OCH_3)_3$
S-3: $CH_2{=}CHSiCl_3$
S-4: $CH_2{=}CHCOO(CH_2)_2Si(CH_3)(OCH_3)_2$
S-5: $CH_2{=}CHCOO(CH_2)_2Si(OCH_3)_3$
S-6: $CH_2{=}CHCOO(CH_2)_2Si(OC_2H_5)(OCH_3)_2$
S-7: $CH_2{=}CHCOO(CH_2)_3Si(OCH_3)_3$
S-8: $CH_2{=}CHCOO(CH_2)_2Si(CH_3)Cl_2$
S-9: $CH_2{=}CHCOO(CH_2)_2SiCl_3$
S-10: $CH_2{=}CHCOO(CH_2)_3Si(CH_3)Cl_2$
S-11: $CH_2{=}CHCOO(CH_2)_3SiCl_3$
S-12: $CH_2{=}C(CH_3)COO(CH_2)_2Si(CH_3)(OCH_3)_2$
S-13: $CH_2{=}C(CH_3)COO(CH_2)_2Si(OCH_3)_3$
S-14: $CH_2{=}C(CH_3)COO(CH_2)_3Si(CH_3)(OCH_3)_2$
S-15: $CH_2{=}C(CH_3)COO(CH_2)_3Si(OCH_3)_3$
S-16: $CH_2{=}C(CH_3)COO(CH_2)_2Si(CH_3)Cl_2$
S-17: $CH_2{=}C(CH_3)COO(CH_2)_2SiCl_3$
S-18: $CH_2{=}C(CH_3)COO(CH_2)_3Si(CH_3)Cl_2$
S-19: $CH_2{=}C(CH_3)COO(CH_2)_3SiCl_3$
S-20: $CH_2{=}CHSi(C_2H_5)(OCH_3)_2$
S-21: $CH_2{=}C(CH_3)Si(OCH_3)_3$
S-22: $CH_2{=}C(CH_3)Si(OC_2H_5)_3$
S-23: $CH_2{=}CHSi(OCH_3)_3$
S-24: $CH_2{=}C(CH_3)Si(CH_3)(OCH_3)_2$
S-25: $CH_2{=}CHSi(CH_3)Cl_2$
S-26: $CH_2{=}CHCOOSi(OCH_3)_3$
S-27: $CH_2{=}CHCOOSi(OC_2H_5)_3$
S-28: $CH_2{=}C(CH_3)COOSi(OCH_3)_3$
S-29: $CH_2{=}C(CH_3)COOSi(OC_2H_5)_3$
S-30: $CH_2{=}C(CH_3)COO(CH_2)_3Si(OC_2H_5)_3$
S-31: $CH_2{=}CHCOO(CH_2)_2Si(CH_3)_2\ (OCH_3)$
S-32: $CH_2{=}CHCOO(CH_2)_2Si(CH_3)(OCOCH_3)_2$
S-33: $CH_2{=}CHCOO(CH_2)_2Si(CH_3)(ONHCH_3)_2$
S-34: $CH_2{=}CHCOO(CH_2)_2Si(CH_3)(OC_6H_5)_2$
S-35: $CH_2{=}CHCOO(CH_2)_2Si(C_{10}H_{21})(OCH_3)_2$
S-36: $CH_2{=}CHCOO(CH_2)_2Si(CH_2C_6H_5)(OCH_3)_2$

Furthermore, as the reactive organic group-containing surface preparation agent, silane compounds having a radical polymerizable reactive organic group may be used besides the exemplary compounds (S-1) to (S-36) listed above.

One of the reactive organic group-containing surface preparation agents may be used by itself, or two or more thereof may be mixed and used.

The amount of the reactive organic group-containing surface preparation agent used is preferably 0.1 to 200 parts by mass, more preferably 7 to 70 parts by mass, with respect to 100 parts by mass of the untreated metal oxide particles.

Methods for treating the untreated metal oxide microparticles with the reactive organic group-containing surface preparation include, for example, a method of breaking down slurry containing the untreated metal oxide microparticles and the reactive organic group-containing surface preparation agent (suspension of solid particles) in a wet way. This method prevents reaggregation of the untreated metal oxide microparticles, and at the same time, promotes a surface preparation for the untreated metal oxide microparticles. Thereafter, the solvent is removed to provide a powder.

Examples of the surface preparation equipment include, for example, a wet-type media dispersing device. This wet-type media dispersing device has a container filled with beads as media, and further encompasses a step of grinding and dispersing aggregated particles of untreated metal oxide microparticles by rotating, at high speed, a stirring disk attached perpendicular to a rotating shaft, and the configuration of the device is not limited as long as the untreated metal oxide microparticles can be sufficiently dispersed and subjected to surface treatment when the untreated metal oxide microparticles are subjected to surface treatment, and various types can be adopted, such as, for example, vertical, horizontal, continuous, and batch types. Specifically, a sand mill, an ultra visco mill, a pearl mill, a grain mill, a dyno-mill, an agitator mill, a dynamic mill, and the like can be used. In these dispersing devices, grinding media such as balls and beads are used to carry out fine grinding and dispersion through impact crush, friction, shear, shear stress, or the like.

As the beads for use in the wet-type media dispersing device, it is possible to use balls from glass, alumina, zircon, zirconia, steel, flint stone, etc. as raw materials, but in particular, zirconia and zircon balls are preferred. In addition, as for the bead size, while beads on the order of 1 mm to 2 mm in diameter are typically used, it is preferable to use beads on the order of 0.1 to 1.0 mm in the present invention.

For the disk and the inner wall of the container for use in the wet-type media dispersing device, various materials can be used such as stainless steel, nylon, and ceramic, but disks and container inner walls made of ceramic such as zirconia or silicon carbide are particularly preferred in the present invention.

(Charge Transport Substance)

The specific charge transport substance constituting the protective layer is a compound represented by the general formula (1) mentioned above.

The compound represented by the general formula (1) has a charge transport property of transporting charge carriers in the protective layer, exhibits no absorption in a short-wavelength region, and mostly has a molecular weight of 450 or less (preferably 320 or more and 420 or less), which is able to penetrate into voids of the cured resin constituent in the protective layer. For this reason, the compound makes it possible to smoothly inject charge carriers from the charge transport layer without decreasing the scratch resistance of the protective layer, and transport charge to the protective layer surface without generating any transfer memory.

In the general formula (1), $R_1$, $R_2$, $R_3$, and $R_4$ each represents a hydrogen atom, an alkyl group having 1 to 7 carbon atoms, and an alkoxy group having 1 to 7 carbon atoms, k, l, and n represents an integer of 1 to 5, m represents an integer of 1 to 4. However, when k, l, n, or m is 2 or more, multiple $R_1$, $R_2$, $R_3$ and $R_4$ may be identical to each other, or different from each other.

Examples of the alkyl group having 1 to 7 carbon atoms include a methyl group, an ethyl group, a propyl group, an isopropyl group, an n-butyl group, an isobutyl group, a tert-butyl group, an n-pentyl group, an isopentyl group, a neopentyl group, an n-hexyl group, a 3-methylpentane-2-yl group, a 3-methylpentane-3-yl group, 4-methylpentyl group, a 4-methylpentane-2-yl group, a 1,3-dimethylbutyl group, a 3,3-dimethylbutyl group, a 3,3-dimethylbutane-2-yl group, an n-heptyl group, a 1-methylhexyl group, a 3-methylhexyl group, a 4-methylhexyl group, a 5-methylhexyl group, a 1-ethylpentyl group, a 1-(n-propyl)butyl group, a 1,1-dimethylpentyl group, a 1,4-dimethylpentyl group, a 1,1-diethylpropyl group, a 1,3,3-trimethylbutyl group, and a 1-ethyl-2,2-dimethylpropyl group. Among these groups, the alkyl groups having 1 to 5 carbon atoms are more preferred, and the methyl group, ethyl group, propyl group, n-butyl group, and n-pentyl group are further preferred.

Examples of the alkoxy group having 1 to 7 carbon atoms include a methoxy group, an ethoxy group, an n-propoxy group, an isopropoxy group, an n-butoxy group, an isobutoxy group, a sec-butoxy group, a tert-butoxy group, an n-pentyloxy group, an isopentyloxy group, a neopentyloxy group, a 1,2-dimethyl-propoxy group, an n-hexyloxy group, a 3-methylpentane-2-yloxy group, a 3-methylpentane-3-yloxy group, a 4-methylpentyloxy group, a 4-methylpentane-2-yloxy group, a 1,3-dimethylbutyloxy group, a 3,3-dimethylbutyloxy group, a 3,3-dimethylbutane-2-yloxy group, an n-heptyloxy group, a 1-methylhexyloxy group, a 3-methylhexyloxy group, a 4-methylhexyloxy group, a 5-methylhexyloxy group, a 1-ethylpentyloxy group, a 1-(n-propyl)butyloxy group, a 1,1-dimethylpentyloxy group, a 1,4-dimethylpentyloxy group, a 1,1-diethylpropyloxy group, a 1,3,3-trimethylbutyloxy group, and a 1-ethyl-2,2-dimethylpropyloxy group. Among these groups, the alkoxy groups having 1 to 2 carbon atoms are more preferred, and the methoxy group is further preferred.

In particular, at least one of $R_1$, $R_2$, $R_3$, and $R_4$ preferably has a propyl group, a butyl group, or a pentyl group.

Furthermore, in particular, $R_1$ and $R_2$ are each more preferably a hydrogen atom or a methyl group. Furthermore, more preferably, $R_3$ is a hydrogen atom, $R_4$ is an alkyl group having 1 to 5 carbon atoms. Furthermore, k, l, m, and n are each preferably 1.

Here are specific examples of the compound represented by the general formula (1).

| Compound Example | Structure | Molecular Weight |
|---|---|---|
| | [Chemical Formula 5] | |
| CTM-1 | 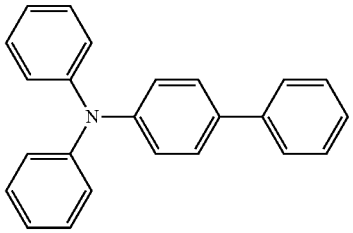 | 321.43 |
| CTM-2 | 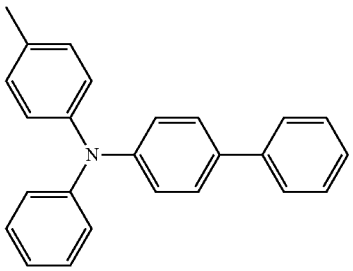 | 335.45 |

-continued
| Compound Example | Structure | Molecular Weight |
|---|---|---|
| CTM-3 | 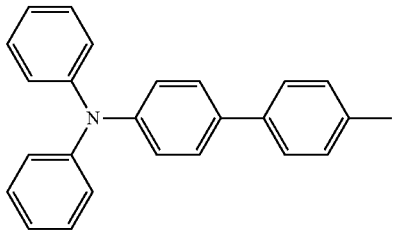 | 335.45 |
| CTM-4 | 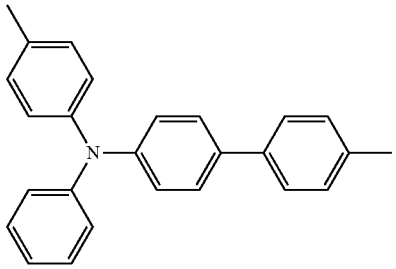 | 349.48 |
| CTM-5 | 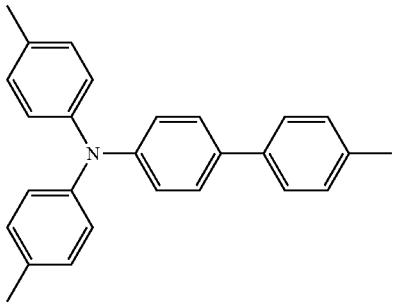 | 363.51 |
[Chemical Formula 6]
| | | |
|---|---|---|
| CTM-6 | 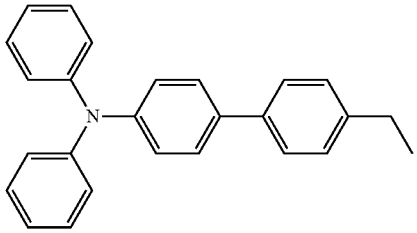 | 349.48 |
| CTM-7 | 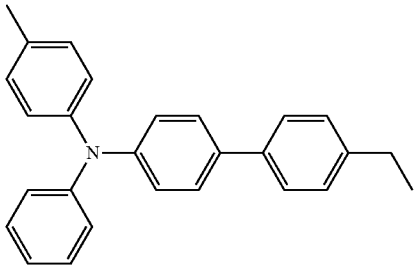 | 363.51 |

-continued
| Compound Example | Structure | Molecular Weight |
|---|---|---|
| CTM-8 | 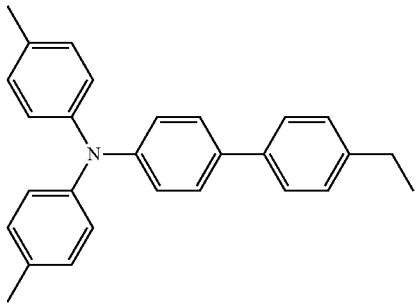 | 377.53 |
| CTM-9 | 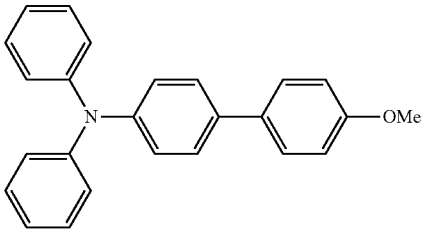 | 351.45 |
| CTM-10 | 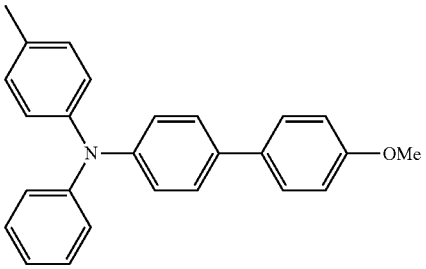 | 365.48 |
[Chemical Formula 7]
| | | |
|---|---|---|
| CTM-11 | 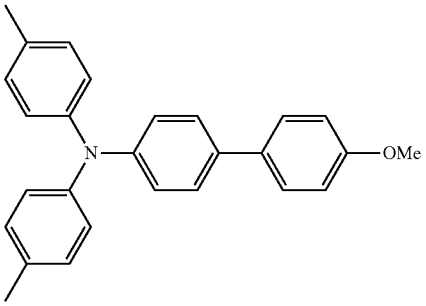 | 379.51 |
| CTM-12 | 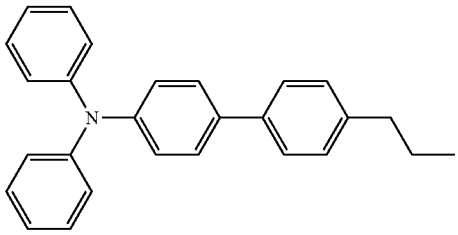 | 363.51 |

-continued
| Compound Example | Structure | Molecular Weight |
|---|---|---|
| CTM-13 | 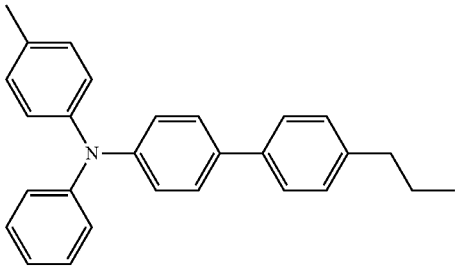 | 377.53 |
| CTM-14 | 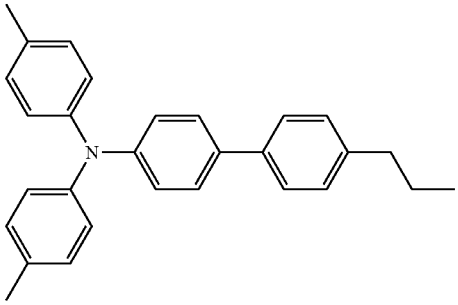 | 391.56 |
| CTM-15 | 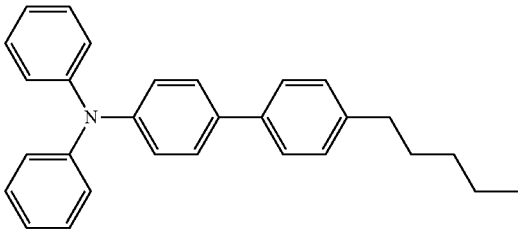 | 391.56 |
[Chemical Formula 8]
| | | |
|---|---|---|
| CTM-16 | 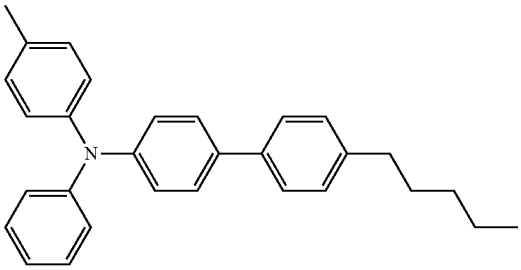 | 405.59 |
| CTM-17 | 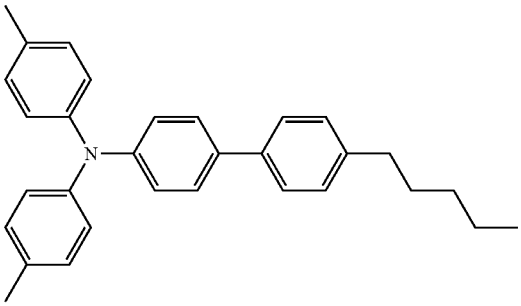 | 419.62 |

-continued

| Compound Example | Structure | Molecular Weight |
|---|---|---|
| CTM-18 | 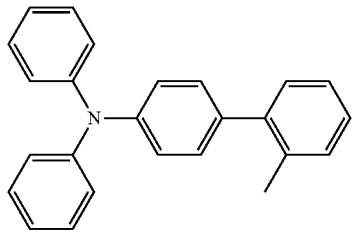 | 335.45 |
| CTM-19 | 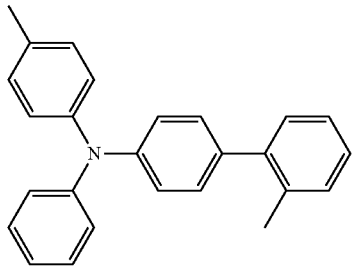 | 349.48 |
| CTM-20 | 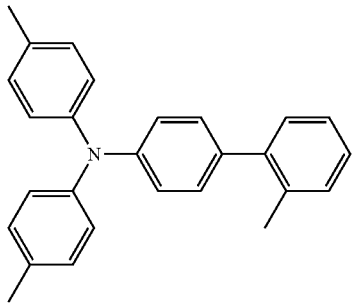 | 349.48 |
| [Chemical Formula 9] | | |
| CTM-21 | 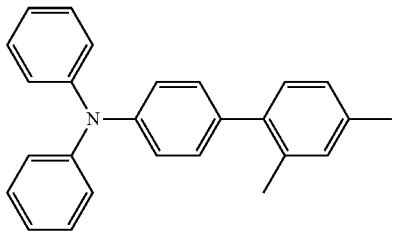 | 349.48 |
| CTM-22 | 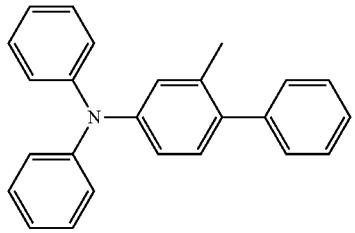 | 335.45 |

In the chemical formulas representing the exemplary compounds (CTM-9) to (CTM-11), however, Me represents a methyl group.

The compound represented by the general formula (1) can be synthesized by known synthesis methods, for example, the method disclosed in JP 2006-143720 A.

According to the present invention, the following relational expression (1) and the relational expression (2) are satisfied when the volume ratio (volume %) of the metal oxide microparticles in the protective layer and the volume ratio (volume %) of the specific charge transport substance in the protective layer are denoted respectively by A and B.

$$80/A \leq B \leq 160/A \quad \text{Relational Expression (1)}$$

$$12 \leq A \leq 25 \quad \text{Relational Expression (2)}$$

When the volume ratios of the metal oxide microparticles and specific charge transport substance satisfy the abovementioned relational expressions in the protective layer, even after use over a long period of time, the generation of transfer memory is suppressed with scratch resistance, and images can be formed which are excellent in dot reproducibility. Specifically, when the volume ratio A of the metal oxide microparticles falls within the range of 12 volume % or more and 25 volume % or less, whereas the volume ratio B of the specific charge transport substance is 80/A volume % or more, the generation of transfer memory can be suppressed with dot reproducibility achieved, while the protective layer has scratch resistance. Furthermore, when the volume ratio A of the metal oxide microparticles falls within the range of 12 volume % or more and 25 volume % or less, whereas the volume ratio B of the specific charge transport substance is 160/A volume % or less, the specific charge transport substance serves no function as a plasticizer, but dot reproducibility can be achieved while retaining the scratch resistance of the protective layer. Furthermore, the volume ratio A of the metal oxide microparticles more preferably satisfies the range of 12 volume % or more and 21 volume % or less.

According to the present invention, the volume ratio A of the metal oxide microparticles in the protective layer and the volume ratio B of the specific charge transport substance in the protective layer can be converted from the additive amounts (parts by mass) of the metal oxide microparticles and charge transport substance in the step of forming the protective layer. For example, with the organic matter (such as the charge transport substance) regarded as having a specific gravity of 1.1, and as the metal oxide microparticles, for example, with tin oxide, silica, zinc oxide, alumina, and titanium oxide regarded respectively as having specific gravities of 6.9, 2.2, 5.6, 4.0, and 4.0, the volume ratios can be converted.

The protective layer may contain, besides the cured resin constituent, the metal oxide microparticles, and the specific charge transport substance, other constituents, and can contain, for example, various types of antioxidants, and various types of lubricant particles can be also added to the protective layer. For example, fluorine atom-containing resin particles can be added. As the fluorine atom-containing resin particles, it is preferable to appropriately select one, or two or more from among tetrafluoroethylene resins, chlorotrifluoroethylene resins, chlorohexafluoroethylene propylene resins, vinyl fluoride resins, vinylidene fluoride resins, ethylene difluorodichloride resins, and copolymers thereof, and in particular, the tetrafluoroethylene resins and the vinylidene fluoride resins are preferred.

The protective layer is preferably 0.2 μm to 10 μm, and more preferably 0.5 μm to 6 μm in layer thickness.

The photoreceptor configuration other than the protective layer will be described below.

[Conductive Support]

The conductive support constituting the photoreceptor according to the present invention may be any support as long as the support is conductive, and examples of the conductive support include, for example, metals such as aluminum, copper, chromium, nickel, zinc, and stainless steel, which are formed into the shape of a drum or a sheet; metal foil such as aluminum and copper laminated on plastic films; aluminum, indium oxide, tin oxide, etc. deposited on plastic films; metals, plastic films, and papers provided with a conductive layer by applying a conductive substance alone or along with a binder resin.

[Interlayer]

In the case of the photoreceptor according to the present invention, an interlayer that has a barrier function and adhesive function can be also provided between the conductive support and the organic photosensitive layer. In light of prevention of various failures, it is preferable to provide the interlayer.

Such an interlayer contains, for example, a binder resin (hereinafter, also referred to as a "binder resin for interlayer"), and if necessary, conductive particles and metal oxide particles.

Examples of the binder resin for interlayer include, for example, casein, polyvinyl alcohol, nitrocellulose, ethylene-acrylic acid copolymers, polyamide resins, polyurethane resins, and gelatin. Among these resins, alcohol-soluble polyamides are preferred.

The interlayer can contain conductive particles and metal oxide particles for the purpose of resistance adjustment. Various types of metal oxide particles can be used, such as, for example, alumina, zinc oxide, titanium oxide, tin oxide, antimony oxide, indium oxide, and bismuth oxide. Ultrafine particles can be used, such as indium oxide doped with tin, tin oxide doped with antimony, and zirconium oxide.

These metal oxide particles are preferably 0.3 μm or less, more preferably 0.1 μm or less in number primary average particle size.

One type of these metal oxide particles may be used by itself, or two or more types thereof may be mixed and used. When two or more types thereof are used, the mixture may have the form of a solid solution or fusion.

The proportion of the conductive particles or metal oxide particles contained is preferably 20 to 400 parts by mass, more preferably 50 to 350 parts by mass with respect to 100 parts by mass of the binder resin.

The interlayer is preferably 0.1 μm to 15 μm, more preferably 0.3 μm to 10 μm in layer thickness.

[Charge Generation Layer]

The charge generation layer in the organic photosensitive layer constituting the photoreceptor according to the present invention contains a charge generation substance and a binder resin (hereinafter, also referred to as a "binder resin for charge generation layer").

Examples of the charge generation substance include, but not limited to, for example, azo raw materials such as Sudan Red and Dian Blue; quinone pigments such as pyrenequinone and anthanthrone; quinocyanine pigments; perylene pigments; indigo pigments such as indigo and thioindigo; polycyclic quinone pigments such as pyranthrone and diphthaloylpyrene; and phthalocyanine pigments. Among these pigments, the polycyclic quinone pigments and titanyl phthalocyanine pigments are preferred. One of these charge generation substances may be used by itself, or two or more thereof may be mixed and used.

As the binder resin for charge generation layer, known resins can be used, and include, but not limited to, for example, polystyrene resins, polyethylene resins, polypropylene resins, acrylic resins, methacrylic resins, vinyl chloride resins, vinyl acetate resins, polyvinyl butyral resins, epoxy resins, polyurethane resins, phenolic resins, polyester resins, alkyd resins, polycarbonate resins, silicone resins, and melamine resins, as well as copolymer resins two or more of the resins (for example, vinyl chloride-vinyl acetate copolymer resins, vinyl chloride-vinyl acetate-maleic anhydride copolymer resins), and polyvinyl carbazole resins. Among these resins, the polyvinyl butyral resins are preferred.

The proportion of the charge generation substance contained in the charge generation layer is preferably 1 to 600 parts by mass, more preferably 50 to 500 parts by mass with respect to 100 parts by mass of the binder resin for charge generation layer.

The layer thickness of the charge generation layer is preferably 0.01 μm to 5 μm, more preferably 0.05 μm to 3 μm, depending on the properties of the charge generation substance, and the properties and of the binder resin for charge generation layer and the proportion of the resin contained.

[Charge Transport Layer]

The charge transport layer in the organic photosensitive layer constituting the photoreceptor according to the present invention contains the charge transport substance and the binder resin (hereinafter, also referred to as a "binder resin for charge transport layer").

Examples of the charge transport substance in the charge transport layer include, as substances for transporting charges (holes), for example, triphenylamine derivatives, hydrazone compounds, styryl compounds, benzidine compounds, and butadiene compounds.

The charge transport layer formed as a layer under the protective layer preferably contains a charge transport substance that is high in mobility and high in molecular weight, and as such a charge transport substance, a substance is preferably used which is different from the compound represented by the general formula (1).

As the binder resin for charge transport layer, known resins can be used, and include polycarbonate resins, polyacrylate resins, polyester resins, polystyrene resins, styrene-acrylonitrile copolymer resins, polymethacrylic acid ester resins, and styrene-methacrylic acid ester copolymer resins, and the polycarbonate resins are preferred. Furthermore, BPA (bisphenol A) type, BPZ (bisphenol Z) type, dimethyl BPA type, BPA-dimethyl BPA copolymer type polycarbonate resins are preferred in terms of crack resistance, abrasion resistance, and charging characteristics.

The proportion of the charge transport substance contained in the charge transport layer is preferably 10 to 500 parts by mass, more preferably 20 to 250 parts by mass with respect to 100 parts by mass of the binder resin for charge transport layer.

The layer thickness of the charge transport layer is preferably 5 μm to 40 μm, more preferably 10 μm to 30 μm, depending on the properties of the charge transport substance, and the properties of the binder resin for charge transport layer and the proportion of the resin contained.

Antioxidants, electronically conductive agents, stabilizers, silicone oils, etc. may be added to the charge transport layer. As for the antioxidants, those disclosed in JP 2000-305291 A are preferred, and as for the electronically conductive agents, those are preferred which are disclosed in JP 50-137543 A and JP 58-76483 A.

[Method for Producing Organic Photoreceptor]

The method for producing the photoreceptor according to the present invention specifically includes the following steps. Step (1): a step of forming an interlayer by applying an application liquid for interlayer formation to the outer peripheral surface of a conductive support, and drying the liquid. Step (2): a step of forming a charge generation layer by applying an application liquid for charge generation layer formation to the outer peripheral surface of the interlayer formed on the conductive support, and drying the liquid. Step (3): a step of forming a charge transport layer by applying an application liquid for charge transport layer formation to the outer peripheral surface of the charge generation layer formed on the interlayer, and drying the liquid. Step (4): a step of forming a protective layer by applying an application liquid for protective layer formation to the outer peripheral surface of the charge transport layer formed on the charge generation layer, and polymerizing and curing the liquid.

[Step (1): Formation of Interlayer]

The interlayer can be formed in such a way that a binder layer for interlayer is dissolved in a solvent to prepare an application liquid (hereinafter, also referred to as an "application liquid for interlayer formation"), conductive particles or metal oxide particles are dispersed, if necessary, the application liquid is then applied for a certain film thickness onto a conductive support to forma coating film, and the coating film is dried.

Methods for applying the application liquid for interlayer formation include, for example, known methods such as an immersion coating method, a spray coating method, a spinner coating method, a bead coating method, a blade coating method, a beam coating method, a slide hopper method, and a circular slide hopper method.

The method for drying the coating film can be appropriately selected depending on the type of the solvent and the thickness, but is preferably thermal drying.

The solvent for use in the interlayer formation step is preferably a solvent which favorably disperses conductive microparticles or metal oxide microparticles, and dissolves the binder resin for interlayer, in particular, a polyamide resin. Specifically, alcohols having 1 to 4 carbon atoms, such as methanol, ethanol, n-propyl alcohol, isopropyl alcohol, n-butanol, t-butanol, and sec-butanol are preferred which are excellent in polyamide resin solubility and coating performance. In addition, solvents which can be used in combination with the previously mentioned solvents and achieve preferred effects in order to improve storage stability and particle dispersibility include benzyl alcohol, toluene, methylene chloride, cyclohexanone, and tetrahydrofurane.

The concentration of the binder resin for interlayer in the application liquid for interlayer formation appropriately selected depending on the layer thickness of the interlayer and the production rate.

Ultrasonic dispersers, ball mills, sand mills, homomixers, and the like can be used as the unit for dispersing the conductive particles or the metal oxide particles, but the unit is not to be considered limited to these examples.

[Step (2): Formation of Charge Generation Layer]

The charge generation layer can be formed in such a way that a charge generation substance is dispersed in a solvent of the binder resin for charge generation layer dissolved in a solvent to prepare an application liquid (hereinafter, also referred to as an "application liquid for charge generation layer formation"), the application liquid is applied for a certain film layer onto the interlayer to form a coating film, and the coating film is dried.

Methods for applying the application liquid for charge generation layer formation include, for example, known methods such as an immersion coating method, a spray coating method, a spinner coating method, a bead coating method, a blade coating method, a beam coating method, a slide hopper method, and a circular slide hopper method.

The method for drying the coating film can be appropriately selected depending on the type of the solvent and the thickness, but is preferably thermal drying.

Examples of the solvent for use in the formation of the charge generation layer include, but not limited to, for example, toluene, xylene, methylene chloride, 1,2-dichloroethane, methyl ethyl ketone, cyclohexane, ethyl acetate, t-butyl acerate, methanol, ethanol, propanol, butanol, methyl cellosolve, 4-methoxy-4-methyl-2-pentanone, ethyl cellosolve, tetrahydrofurane, 1-dioxane, 1,3-dioxolan, pyridine, and diethylamine.

For example, ultrasonic dispersers, ball mills, sand mills, homomixers, and the like can be used as the unit for dispersing the charge generation substance, but the unit is not to be considered limited to these examples.

[Step (3): Formation of Charge Transport Layer]

The charge transport layer can be formed in such a way that an application liquid (hereinafter, also referred to as an "application liquid for charge transport layer formation") which has a binder resin for charge transport layer and a charge transport layer dissolved in a solvent, the application liquid is applied for a certain thickness onto the charge generation layer to form a coating film, and the coating film is dried.

Methods for applying the application liquid for charge transport layer formation include, for example, known methods such as an immersion coating method, a spray coating method, a spinner coating method, a bead coating method, a blade coating method, a beam coating method, a slide hopper method, and a circular slide hopper method.

The method for drying the coating film can be appropriately selected depending on the type of the solvent and the thickness, but is preferably thermal drying.

Examples of the solvent for use in the formation of the charge transport layer include, but not limited to, for example, toluene, xylene, methylene chloride, 1,2-dichloroethane, methyl ethyl ketone, cyclohexanone, ethyl acetate, butyl acerate, methanol, ethanol, propanol, butanol, tetrahydrofurane, 1,4-dioxane, 1,3-dioxolan, pyridine, and diethylamine.

[Step (4): Formation of Protective Layer]

The protective layer can be formed in such a way that a polymerizable compound, a specific radical scavenger, metal oxide microparticles, a specific electron transport substance, a polymerization initiator, and if necessary, other constituents are added to a known solvent to prepare an application liquid (hereinafter, also referred to as "application liquid for protective layer formation"), this application liquid for protective layer formation is applied to the outer peripheral surface of the charge transport layer formed through the step (3) to form a coating film, and the coating film is dried, and irradiated with actinic rays such as ultraviolet rays or electron beams to polymerize and cure the polymerizable compound constituent in the coating film.

In the application liquid for protective layer formation, the specific radical scavenger is preferably added in a proportion of 1 to 30 parts by mass, more preferably 3 to 20 parts by mass with respect to 100 parts by mass of the whole monomer (polymerizable compound) for forming the cured resin constituent.

The proportion of the specific radical scavenger added within the range mentioned above results in a formed protective layer which has appropriate film strength, and in photoreceptor surface with appropriate wear and tear by cleaning unit such as a blade.

Ultrasonic dispersers, ball mills, sand mills, homomixers, and the like can be used as the unit for dispersing the metal oxide microparticles in the application liquid for surface layer formation, but the unit is not to be considered limited to these examples.

As the solvent for use in the formation of the protective layer, any solvent can be used as long as the solvent can dissolve or disperse the polymerizable compound, the metal oxide microparticles, and the specific charge transport substance, and examples of the substance include, but not limited to, for example, methanol, ethanol, n-propyl alcohol, isopropyl alcohol, n-butanol, t-butanol, sec-butanol, benzyl alcohol, toluene, xylene, methylene chloride, methyl ethyl ketone, cyclohexane, ethyl acetate, butyl acetate, methyl cellosolve, ethyl cellosolve, tetrahydrofurane, 1-dioxane, 1,3-dioxolan, pyridine, diethylamine.

Methods for applying the application liquid for protective layer formation include, for example, known methods such as an immersion coating method, a spray coating method, a spinner coating method, a bead coating method, a blade coating method, a beam coating method, a slide hopper method, and a circular slide hopper method.

The application liquid for protective layer formation is preferably applied with the use of a circular slide hopper coating applicator.

A method for applying the application liquid for protective layer formation with the use of a circular slide hopper coating applicator will be specifically described below.

As shown in FIG. 1, the circular slide hopper coating applicator is composed of a cylindrical base material 251, an annular application head 260 provided to surround the circumference of the material, and a storage tank 254 for storing an application liquid L.

The base material 251 herein is a base material to which the application liquid for protective layer formation is to be applied, and for example, an interlayer and an organic photosensitive layer formed on a conductive support (without any protective layer formed).

The application head 260 has a narrow application liquid distribution slit 262 with an application liquid issue 261 opening to the base material 251, which is formed all around the annular application head 260 in a direction perpendicular to the longitudinal direction of the base material 251. This application liquid distribution slit 262 is communicated with an annular application liquid distribution room 263, and this annular application liquid distribution room 263 is formed to so as to supply the application liquid L in the storage tank 254 through a supply pipe 264 with a squeeze pump 255.

Below the application liquid issue 261 of the application liquid distribution slit 262, a slide face 265 is formed which is continuously inclined downward and formed to terminate in a somewhat larger size than the outer size of the base material 251, and a labrum (bead; fluid reservoir) 266 is further formed which extends downward from the end of the slide face 265.

In this circular slide hopper coating applicator, in the process of moving the base material 251 in the direction of arrow, when the application liquid L is pushed from the application liquid distribution slit 262 and traveled down along the slide face 265, the application liquid L reaching the end of the slide face 265 forms a bead between the end of the slide face 265 and the outer peripheral face of the base material 251, and then applies to the surface of the base material 251 to forma coating film F, and the excessive application liquid L is discharged from an outlet 267.

This application method with the use of the circular slide hopper coating applicator can achieve the application without scratching the base material because the end of the slide face and the base material are placed at a certain interval (about 2 μm to 2 mm), or without damaging any layer already applied even in the case of forming multiple layer which are different in property. Furthermore, in the formation of multiple layers which are different in property and dissolved in the same solvent, the residence time in the solvent is much shorter as compared with an immersion coating method, the application can be thus achieved with almost no elution of lower layer constituents toward the upper layer, or without elution into the application bath, and thus, the application can be achieved, for example, without degrading the dispersibility of the metal oxide microparticles.

The coating film may be subjected to curing treatment without drying, but is preferably subjected to natural drying or thermal drying, and then to curing treatment.

The conditions for the drying can be appropriately selected depending on the type of the solvent, the film thickness, etc. The drying temperature is preferably room temperature to 180° C., particularly preferably 80° C. to 140° C. The drying time is preferably 1 minute to 200 minutes, particularly preferably 5 minutes to 100 minutes.

Methods for reacting the polymerizable compound include a reaction method with electron beam cleavage, and a reaction method with light or heat through the addition of a radical polymerization initiator. For the radical polymerization initiator, any of photopolymerization initiators and thermal polymerization initiators can be used. In addition, the photopolymerization initiators and thermal polymerization initiators can be used in combination.

As the radical polymerization initiator, photopolymerization initiators are preferred, and above all, alkylphenone compounds or phosphine oxide compounds are preferred. In particular, compounds are preferred which have an α-hydroxyacetophenone structure or an acylphosphineoxide structure.

Here are specific examples of the acylphosphineoxide compound as the photopolymerization initiator.

[Chemical Formula 10]

P1

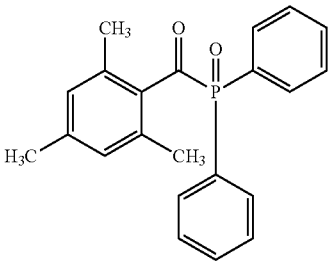

P2

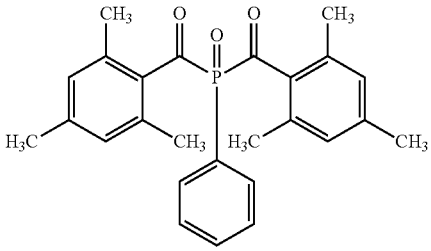

One of the polymerization initiators may be used by itself, or two or more thereof may be mixed and used.

The proportion of the polymerization initiator added is preferably 0.1 to 20 parts by mass, more preferably 0.5 to 10 parts by mass with respect to 100 parts by mass of the whole monomer (polymerizable compound) for forming the cured resin constituent.

The cured resin constituent is produced by, as the curing treatment, irradiating the coating film with actinic rays to generate radicals for the polymerization, and forming cross-linking bonds through intermolecular and intramolecular cross-linking reactions for the curing. The actinic rays are more preferably ultraviolet rays and electron beans, and ultraviolet rays are easily used and thus particularly preferred.

As a light source for the ultraviolet rays, any light source can be used without any limitation as long as the light source is a light source that generates ultraviolet rays. For example, low-pressure mercury vapor lamps, medium-pressure mercury vapor lamps, high-pressure mercury vapor lamps, ultra-high pressure mercury vapor lamps, carbon-arc lamps, metal halide lamps, xenon lamps, flash (pulse) xenon, and the like can be used.

The irradiation condition varies depending on the respective lamps, and the irradiance level of the actinic rays is typically 5 mJ/cm$^2$ to 500 mJ/cm$^2$, preferably 5 mJ/cm$^2$ to 100 mJ/cm$^2$.

The lamp wattage is preferably 0.1 kW to 5 kW, particularly preferably 0.5 kW to 3 kW.

As for the source for electron beams, the electron beam irradiator is not particularly limited, but in general, a relatively inexpensive curtain beam-type accelerator which provides a large amount of power is effectively used as an electron beam accelerator for such electron bean irradiation. The acceleration voltage for the electron beam irradiation is preferably 100 kV to 300 kV. The absorbed dose is preferably 0.5 Mrad to 10 Mrad.

The irradiation time for achieving the required irradiance level of actinic rays is preferably 0.1 seconds to 10 minutes, more preferably 0.1 seconds to 5 seconds from the perspective of work efficiency.

In the step of protective formation step, drying can be carried out before and after the actinic ray irradiation and during the actinic ray irradiation, and the timing of for carrying out the drying can be selected appropriately by combining before, after, and during the actinic ray irradiation.

In the organic photoreceptor just described, the protective layer contains: the cured resin constituent obtained by polymerizing the polymerizable compound in the presence of the specific radical scavenger; the metal oxide microparticles; and the specific charge transport substance, and the mixing ratios (volume ratios) of the metal oxide microparticles and specific charge transport substance satisfy the relational expression (1) and the relational expression (2). Thus, even after use over a long period of time, the generation of transfer memory is suppressed with scratch resistance, and images with excellent dot reproducibility can be formed.

[Image Forming Apparatus]

The image forming apparatus according to the present invention includes: an organic photoreceptor; a first charging unit for charging the surface of the organic photoreceptor; an exposure unit for irradiating the surface of the organic photoreceptor with light to form an electrostatic latent image; a development unit for developing the electrostatic latent image with a toner to form a toner image; a transfer unit for transferring the toner image to a transfer material; a second charging unit for charging the surface of the organic photoreceptor after transferring the toner image to the transfer material; and a cleaning unit for removing a residual toner on the organic photoreceptor, and as the organic photoreceptor, the organic photoreceptor according to the present invention is used.

Figure 3:
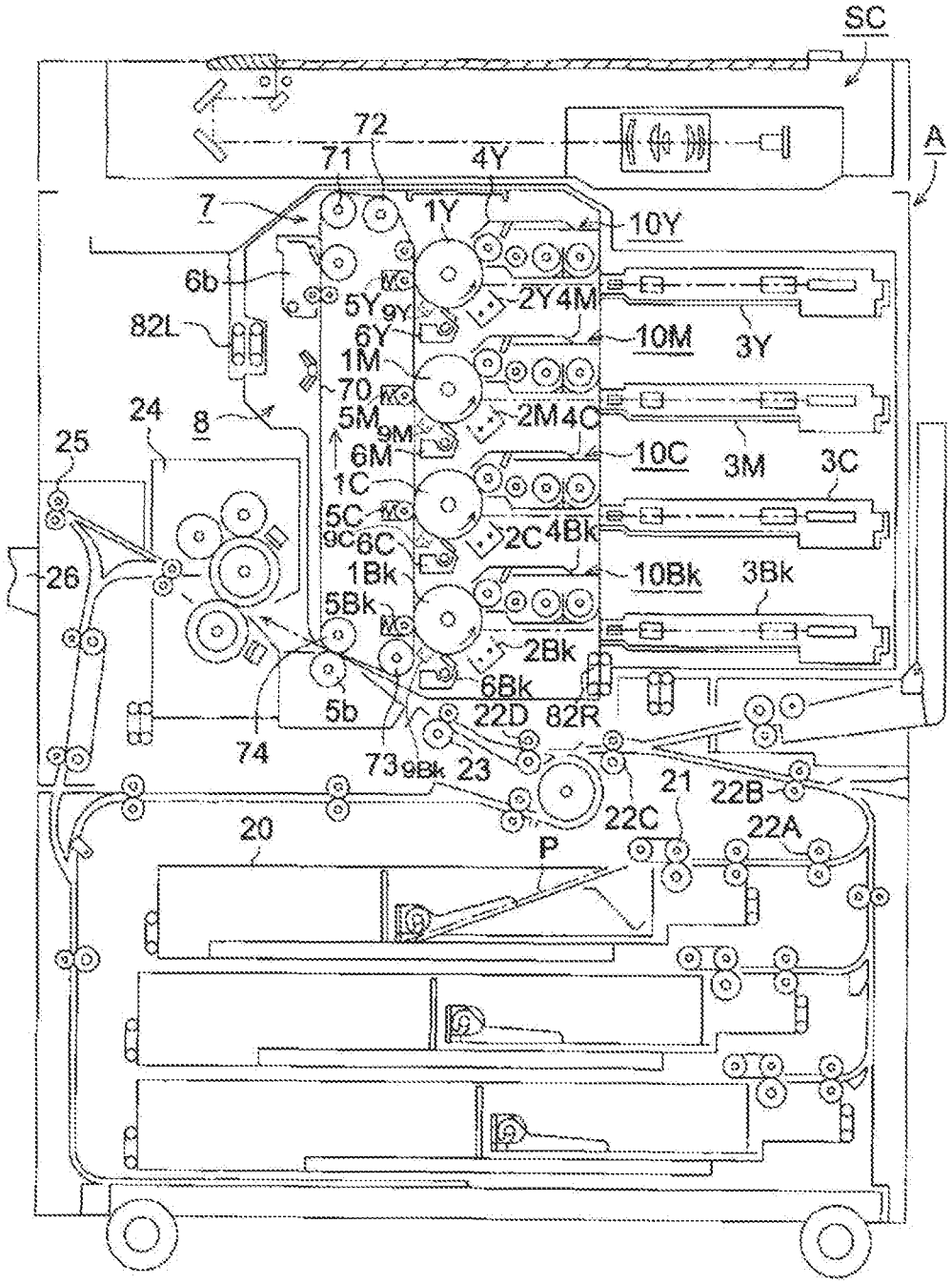
FIG. 3 is an explanatory cross-sectional view illustrating the configuration of an image forming apparatus example according to an embodiment of the present invention.

FIG. 3 is an explanatory cross-sectional view illustrating the configuration of an image forming apparatus example according to the present invention.

This image forming apparatus is referred to as a tandem-type color image forming apparatus, which is composed of four sets of image forming units 10Y, 10M, 10C, and 10Bk, an endless belt-like intermediate transfer unit 7, a paper feeding and conveying unit 21, and a fuser unit 24. A main body A of the image forming apparatus has an upper section with a copy image scanner SC placed.

The image forming unit 10Y for forming yellow images has a first charging unit 2Y, an exposure unit 3Y, a development unit 4Y, a primary transfer roller 5Y as a primary transfer unit, a second charging unit 9Y, and a cleaning unit 6Y, which are sequentially placed around a drum-shaped photoreceptor 1Y in the rotational direction of the photoreceptor 1Y. The image forming unit 10M for forming magenta images has a first charging unit 2M, an exposure unit 3M, a development unit 4M, a primary transfer roller 5M as a primary transfer unit, a second charging unit 9M, and a cleaning unit 6M, which are sequentially placed around a drum-shaped photoreceptor 1M in the rotational direction of the photoreceptor 1M. The image forming unit 10C for forming cyan images has a first charging unit 2C, an exposure unit 3C, a development unit 4C, a primary transfer roller 5C as a primary transfer unit, a second charging unit 9C, and a cleaning unit 6C, which are sequentially placed around a drum-shaped photoreceptor 1C in the rotational direction of the photoreceptor 1C. The image forming unit 10Bk for forming black images has a first charging unit 2Bk, an exposure unit 3Bk, a development unit 4Bk, a primary transfer roller 5Bk as a primary transfer unit, a second charging unit 9Bk, and a cleaning unit 6Bk, which are sequentially placed around a drum-shaped photoreceptor 1Bk in the rotational direction of the photoreceptor 1Bk. The image forming apparatus according to the present invention uses, as the photoreceptors 1Y, 1M, 1C, and 1Bk, the photoreceptor according to the present invention as described above.

The image forming units 10Y, 10M, 10C, and 10Bk have the same configuration while toner images formed on the photoreceptors 1Y, 1M, 1C, and 1Bk differ in color, and the image forming unit 10Y will be described in detail as an example.

The image forming unit 10Y has the first charging unit 2Y, exposure unit 3Y, development unit 4Y, primary transfer roller 5Y, second charging unit 9Y, and cleaning unit 6Y placed around the photoreceptor 1Y as an image forming body, to form toner images in yellow (Y) on the photoreceptor 1Y. In addition, according to the present embodiment, at least the photoreceptor 1Y, first charging unit 2Y, development unit 4Y, second charging unit 9Y, and cleaning unit 6Y are provided to be integrated in the image forming unit 10Y.

The first charging unit 2Y is a unit for applying a uniform electric potential to the photoreceptor 1Y, for which a corona discharge-type charger is used in the present embodiment.

The exposure unit 3Y is a unit for forming an electrostatic latent image corresponding to a yellow image through exposure carried out in response to an image signal (yellow) on the photoreceptor 1Y with the uniform electric potential applied thereto by the first charging unit 2Y, and as this exposure unit 3Y, a unit composed of: a LED of light-emitting elements arranged in an array form in the axial direction of the photoreceptor 1Y; and an imaging element, or a laser optical system or the like is used.

The development unit 4Y is composed of: for example, a rotating development sleeve that has a magnet built-in with a developer held; and a voltage application unit for applying a DC and/or AC bias voltage between the photoreceptor and the development sleeve.

The primary transfer roller 5Y is a unit for transferring the toner image formed on the photoreceptor 1Y to endless belt-like intermediate transfer body 70. The primary transfer roller 5Y is placed in abutment with the intermediate transfer body 70.

The second charging unit 9Y is a neutralization unit for charging (neutralizing) the surface of the photoreceptor 1Y after transferring the toner image to the intermediate transfer body 70. In the present embodiment, a corona discharge-type charger is used.

The image forming apparatus according to the present invention includes the organic photoreceptor according to the present invention, and has the neutralization unit provided, thereby making it possible to ensure that the generation of transfer memory can be suppressed.

The cleaning unit 6Y is composed of a cleaning blade; and a brush roller provided upstream of the cleaning blade.

Figure 4:
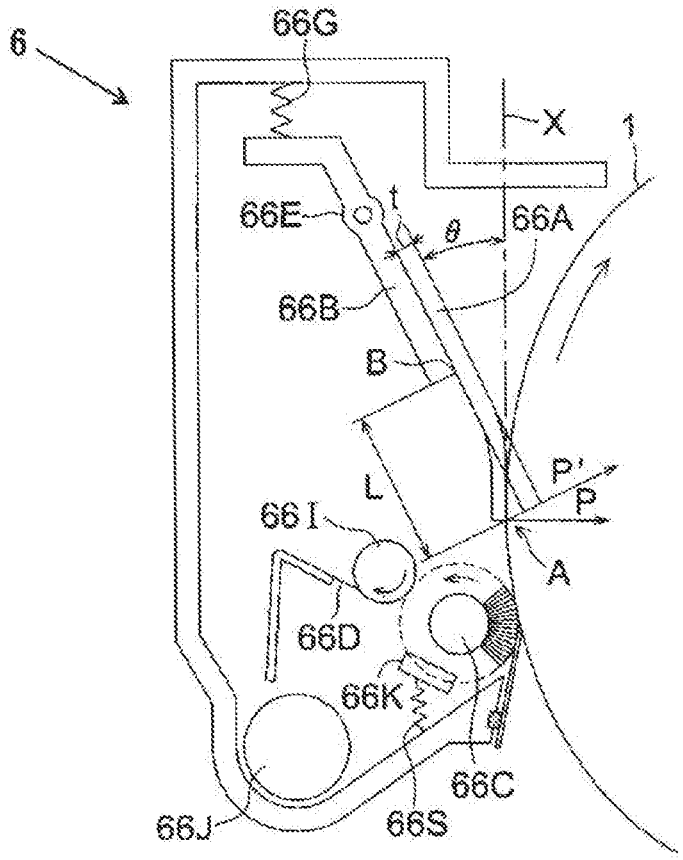
FIG. 4 is an explanatory cross-sectional view illustrating the configuration of a cleaning unit example in an image forming apparatus according to an embodiment of the present invention.

Specifically, as shown in FIG. 4, the cleaning unit 6 is composed of: a cleaning blade 66A provided to have an head in abutment with the surface of the photoreceptor 1; and a brush roller 66C in contact with the surface of the photoreceptor 1, which is provided upstream of the cleaning blade.

The cleaning blade 66A has the function of removing residual toner adhering to the photoreceptor 1, and also, the function of providing the surface of the photoreceptor 1 with wear and tear.

The cleaning blade 66A is supported by a support member 66B. As the material of the cleaning blade 66A, a rubber elastic body is used, urethane rubbers, silicon rubbers, fluorine-containing rubbers, chloroprene rubbers, butadiene rubbers, and the like are known as the material, and among these rubbers, the urethane rubbers are particularly preferred in that the rubbers have excellent abrasion characteristics as compared with the other rubbers.

The support member 66B is composed of a plate-like metallic member or plastic member. Examples of the metallic member include stainless-steel plates, aluminum plates, and vibration-control steel plates.

In the present invention, the head of the cleaning blade 66A in abutment with the surface of the photoreceptor 1 preferably abuts with a load put in an opposite direction (counter direction) with respect to the rotational direction of the photoreceptor 1. As shown in FIG. 4, the head of the cleaning blade 66A preferably forms an abutting surface in the case of abutment with the photoreceptor 1.

The abutting load P and abutting angle θ of the cleaning blade 66A on the photoreceptor 1 preferably have values of: P=5 N/m to 40 N/m and θ=5° to 35°.

The abutting load P refers to a vector value of the butting force P' in the normal direction in the case of the cleaning blade 66A in abutment with the drum-shaped photoreceptor 1.

In addition, the abutting angle θ represents an angle made by the tangent line X on a abutting point A of the photoreceptor 1 and the undeformed blade.

Reference numeral 66E denotes a rotating shaft that makes the support member 66B rotatable, and reference numeral 66G denotes a load spring.

The free length L is preferably 6 to 15 mm.

The free length L of the cleaning blade 66A refers to, as shown in FIG. 4, the length from the location of an end B of the support member 66B to the head of the undeformed cleaning blade 66A.

The thickness t of the cleaning blade 66A is preferably 0.5 mm to 10 mm.

The thickness t of the cleaning blade 66A herein refers to the length in a direction perpendicular to an adhesive surface of the support member 66B as shown in FIG. 4.

The brush roller 66C has the function of removing residual toner adhering to the photoreceptor 1 and collecting the residual toner removed by the cleaning blade 66A, and also, the function of providing the surface of the photoreceptor 1 with wear and tear. More specifically, the brush roller 66C comes into contact with the surface of the photoreceptor 1, and in the contact region, rotates in the same direction as the traveling direction of the photoreceptor 1 to remove residual toner and paper powder on the photoreceptor 1, also convey the residual toner removed by the cleaning blade 66A, and collect the residual toner into a conveying screw 66J. Then, the surface of the photoreceptor 1 is scraped for refresh.

Removed substances such as the residual toner transferred from the photoreceptor 1 to the brush roller 66C are preferably removed with a flicker 66I as a removing unit in abutment with the brush roller 66C. Furthermore, the toner adhering to the flicker 66I is removed with a scraper 66D, and collected into the conveying screw 66J. The collected toner is extracted to the outside as a waste product, or conveyed to the developer via a recycle pipe (not shown) for toner recycle and recycled.

For the flicker 66I, a metallic pipe such as stainless steel and aluminum is used preferably.

For the scraper 66D, an elastic plate is used such as a phosphor-bronze plate, a polyethylene terephthalate plate, and a polycarbonate plate, and a head thereof preferably abuts in a counter manner that forms an acute angle with respect to the rotational direction of the flicker 66I.

A solid material of antioxidant (a solid material of an antioxidant and a zinc stearate or the like) 66K is attached to the brush roller 66C with the material pushed by a load spring 66S, and the brush roller 66C rotates, and at the same time, scratches the solid material of antioxidant 66K to supply the antioxidant to the surface of the photoreceptor 1.

As the brush roller 66C, a conductive or a semi-conductive brush roller is used. For the brush constituent material of the brush roller 66C, any material can be used, but it is preferable to use a fiber-forming high molecular weight polymer which is hydrophobic and high in dielectric constant. Examples of such a high molecular weight polymer include, for example, rayon, nylon, polycarbonate, polyester, methacrylic resins, acrylic resin, polyvinyl chloride, polyvinylidene chloride, polypropylene, polystyrene, polyvinyl acetate, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkydresins, phenol-formaldehyde resins, styrene-alkyd resins, and polyvinyl acetal (for example, polyvinyl butyral). These resins can be used singly, or as mixtures of two or more thereof. Particularly preferred are rayon, nylon, polyester, acrylic resins, and polypropylene.

For the brush roller 66C, a conductive or non-conductive roller can be also used, and for the constituent material, materials can be used which contain a low-resistance substance such as carbon to make an adjustment to any resistivity.

Per bristle of the brush for use in the brush roller 66C, the thickness is preferably 5 deniers to 20 deniers. The thickness less than 5 deniers results in failure to remove the surface adhesion matter, because of lack of sufficient scratching force. On the other hand, the thickness larger than 20 deniers, because of the rigid brush, scratches the surface of the photoreceptor 1, and moreover promotes abrasion to lower the life of the photoreceptor 1.

The term "denier" refers to a numerical value obtained by measuring the mass of the brush bristles (fibers) constituting the brush roller 66C for 9000 m in length in terms of g (gram).

The brush bristle density of the brush roller 66C is $4.5\times10^2/cm^2$ to $2.0\times10^4/cm^2$ (the number of brush bristles per square centimeter).

The brush bristle density less than $4.5\times10^2/cm^2$ results in failure to uniformly remove the adhesion matter, because of the low degree of rigidity, the weak scratching force, and moreover uneven scratching. The density higher than $2.0\times10^4/cm^2$ results in the photoreceptor 1 excessively abraded because rigidity makes the scratching force stronger, thereby causing defective images such as fogging due to decreased sensitivity and black lines due to scratches.

The digging of the brush roller 66C into the photoreceptor 1 is preferably set to 0.4 mm to 1.5 mm.

This digging means the load on the brush roller 66C, which is caused by a relative movement between the drum of the photoreceptor 1 and the brush roller 66C. This load corresponds, from the standpoint of the drum of the photoreceptor 1, to the scratching force received from the brush roller 66C, and the specified range of the force means that there is a need for the photoreceptor 1 to be scratched by an appropriate force.

In addition, the digging refers to the length of inward digging on the assumption that the brush bristle goes inside in a linear fashion without bending at the surface of the photoreceptor 1 in the case of the brush roller 66C in abutment with the photoreceptor 1.

As a core material of the roller section for use in the brush roller 66C, metal such as stainless steel and aluminum, paper, plastic, or the like is mainly used, but the core material is not to be considered limited by these examples.

The brush roller 66C preferably rotates so that the abutment moves in the same direction with the surface of the photoreceptor 1. The movement of the abutment in the opposite direction may spill the toner removed by the brush roller 66C to contaminate recording paper or the apparatus in some cases, when there is an excessive toner on the surface of the photoreceptor 1.

When the photoreceptor 1 and the brush roller 66C move in the same direction, the surface speed ratio between the both preferably has a value within the range of 1:1.1 to 1:2.

As the image forming apparatus according to the present invention, the photoreceptor described above and the constituent elements such as the development unit and the cleaning unit may be integrally coupled as a process cartridge (image forming unit), and this image forming unit may be removably combined with the main body of the apparatus. Alternatively, at least one of the charging unit, exposure unit, development unit, transfer unit, and cleaning unit may be integrally supported along with the photoreceptor to form a process cartridge (image forming unit) regarded as a single image forming unit removably attached to the main body of the apparatus, and a guiding unit such as a rail of the main body of the apparatus may be used to provide a removable configuration.

The endless belt-like intermediate transfer unit 7 has the endless belt-like intermediate transfer body 70 as a semiconductive endless belt-like second image supporter, which is wound on a plurality of rollers 71, 72, 73, and 74 and supported rotatably. On the endless belt-like intermediate transfer unit 7, a cleaning unit 6*b* is placed for removing the toner on the intermediate transfer body 70.

Examples of the fuser unit 24 include, for example, a thermal roller fusion type composed of a heating roller provided with a heating source therein and a pressure roller subjected to pressure welding to forma fusing nip on the heating roller.

The thus configured image forming apparatus forms toner images through the image forming units 10Y, 10M, 10C, and 10Bk. Specifically, first, the first charging unit 2Y, 2M, 2C, and 2Bk are discharged to the surfaces to the photoreceptors 1Y, 1M, 1C, and 1Bk to negatively charge the surfaces. Then, through the exposure unit 3Y, 3M, 3C, and 3Bk, the surfaces of photoreceptors 1Y, 1M, 1C, and 1Bk are exposed in response to image signals to form electrostatic latent images. Then, through the development unit 4Y, 4M, 4C, and 4Bk, toners are provided onto the surfaces of photoreceptors 1Y, 1M, 1C, and 1Bk to achieve development, thereby forming toner images.

Then, the primary transfer rollers (primary transfer unit) 5Y, 5M, 5C, and 5Bk are brought into abutment with the rotating intermediate transfer body 70. Thus, the toner images in respective colors, which are respectively formed on the photoreceptors 1Y, 1M, 1C, and 1Bk, are sequentially transferred onto the rotating intermediate transfer body 70 to transfer (primarily transfer) color images. During the image forming process, the primary transfer roller 70Bk is always in abutment with the photoreceptor 1Bk. On the other hand, the other primary transfer rollers 5Y, 5M, and 5C are respectively brought into abutment with the corresponding photoreceptors 1Y, 1M, and 1C only in color image formation.

Then, after separating the primary transfer rollers 5Y, 5M, 5C, and 5Bk from the intermediate transfer body 70, the surfaces of the photoreceptors 1Y, 1M, 1C, and 1Bk are neutralized by the second charging unit 9Y, 9M, 9C, and 9Bk. Thereafter, the toners remaining on the surfaces of the photoreceptors 1Y, 1M, 1C, and 1Bk are removed by the cleaning unit 6Y, 6M, 6C, and 6Bk. Then, in preparation for the next image forming process, the surfaces are negatively charged by the charging unit 2Y, 2M, 2C, and 2Bk.

On the other hand, a transfer material P (a support for supporting a final image, such as, for example, a plain paper of a transparent sheet) held in a paper feeding cassette 20 is fed by the paper feeding unit 21, and conveyed through a plurality of intermediate rollers 22A, 22B, 22C, and 22D, and resist roller 23 to a secondary transfer roller (secondary transfer unit) 5*b*. Then, the secondary transfer roller 5*b* is brought into the rotating intermediate transfer body 70 to collectively transfer (secondarily transfer) the color image onto the transfer material P. The secondary transfer roller 5*b* is brought into abutment with the intermediate transfer body 70 only in the case of secondary transfer onto the transfer material P. Thereafter, the transfer material P with the color image collectively transferred thereon is separated at a site of the intermediate transfer body 70 with an increased curvature.

The transfer material P with the color image collectively transferred thereon in this way is subjected to fusing treatment by the fuser unit 24, then sandwiched between paper ejecting rollers 25, and placed on a catch tray 26 outside the apparatus. In addition, after the transfer material P with the color image collectively transferred thereon is separated from the intermediate transfer body 70, the remaining toner on the intermediate transfer body 70 is removed by the cleaning unit 6*b*.

Furthermore, a housing 8 is able to be drawn via support rails 82L and 82R from the main body A of the apparatus.

The housing 8 is composed of the image forming units 10Y, 10M, 10C, and 10Bk, and the endless belt-like intermediate transfer unit 7.

It is to be noted that while the image forming apparatus shown in FIG. 3 represents a color laser printer, the invention is also applicable to black and white laser printers and copiers. In addition, also as for the light source for exposure, light sources other than lasers, for example, LED light sources may be used.

The image forming apparatus as described above is provided with the photoreceptor which has scratch resistance, and has excellent memory tolerance and dot reproducibility, and with the second charging unit (neutralization unit), and thus, even after use over a long period of time, the generation of transfer memory can be certainly suppressed, and images with excellent dot reproducibility can be formed.

[Toner]

The toners for use in the image forming apparatus according to the present invention is not particularly limited, but composed of toner particles containing a bonding resin and a colorant, and the toner particles may contain other desired constituents such as a mold release agent.

The toner particles constituting the toners are preferably 2 μm to 8 μm in volume average particle size, from the perspective of making an attempt to enhance the image quality.

The methods for producing the toners are not particularly limited, but include, for example, common grinding methods, wet melting spheronization methods for preparation in dispersion media, and known polymerization methods such as suspension polymerization, dispersion polymerization, and emulsion polymerization aggregation methods.

In addition, appropriate amounts of inorganic microparticles such as silica and titania on the order of 10 nm to 300 nm in average particle size and abrasive on the order of 0.2 μm to 3 μm can be externally added as external additives to the toner particles.

The toners can be also as magnetic or non-magnetic monocomponent developers, but may be mixed with a carrier for use as binary developers.

In the case of using the toners as binary developers, as the carrier, magnetic particles of conventionally known materials can be used such as ferromagnetic metals, e.g., iron, alloys of ferromagnetic metals with aluminum and lead, and compounds of ferromagnetic metals, e.g., ferrite and magnetite.

[Image Forming Method]

The image forming method according to the present invention uses the image forming apparatus described above for image formation. In the image forming method according to the present invention, the image forming apparatus according to the present invention is used for image formation. Thus, even after use over a long period of time, the generation of transfer memory is certainly suppressed, and images with excellent dot reproducibility can be formed.

EXAMPLES

While the present invention will be described in detail below with reference to examples, the present invention is not to be considered limited to only the following examples. It is to be noted that the term "parts" in the following indicates "parts by mass".

[Preparation Example 1 of Photoreceptor]

The surface of a cylindrical aluminum support of 60 mm in diameter was subjected to cutting work to prepare a conductive support [1] with a surface finely roughened.

(Formation of Interlayer)

(1) Preparation of Surface-Treated Metal Oxide Particles [1]

After mixing and stirring 500 parts of rutile-type titanium oxide particles "MT-500SA" (from Tayca Corporation) of 35 nm in number average primary particle size, subjected to silica treatment and alumina treatment, 25 parts of methyl hydrogen polysiloxane (MHPS) "KF-99" (from Shin-Etsu Chemical Co., Ltd.), and 1500 parts of toluene, a ceramic bead mill was used to carry out breaking treatment for mill residence time of 25 minutes, the temperature of the obtained slurry was gradually risen under reduced pressure while stirring to distil away the solvent, and the MHPS was continuously baked by keeping at 120° C. for 2 hours. Thereafter, the surface-treated metal oxide particles [1] were obtained through grinding and classification.

(2) Preparation of Surface-Treated Metal Oxide Particles [2]

After mixing and stirring 500 parts of rutile-type titanium oxide particles "MT-150A" (from Tayca Corporation) of 15 nm in number average primary particle size, 60 parts of 3-methacryloxypropyltrimethoxysilane particles "KBM-503" (from Shin-Etsu Chemical Co., Ltd.), and 2000 parts of toluene, a ceramic bead mill was used to carry out breaking treatment for mill residence time of 40 minutes, the temperature of the obtained slurry was gradually risen under reduced pressure while stirring to distil away the solvent, and the "KBM-503" was continuously baked by keeping at 120° C. for 2 hours. Thereafter, the surface-treated metal oxide particles [2] were obtained through grinding and classification.

(3) Formation of Interlayer

To 1700 parts of a mixed solvent of ethanol/n-propyl alcohol/tetrahydrofurane (volume ratio 60/20/20), 100 parts of the following polyamide resin (N-1) as a binder resin was added, and dissolved by stirring and mixing. To this solution, 120 parts of the surface-treated metal oxide particles [1] and 160 parts of the surface-treated metal oxide particles [2] were added, and dispersed by a ceramic bead mill for mill residence time of 3 hours. This solution was left still standing all night and all day, and filtered to prepare an application liquid for interlayer formation. The filtration was carried out with the use of, as a filter, a polypropylene filter with nominal filtration accuracy of 10 μm (from Roki Techno Co., Ltd.). The obtained application liquid for interlayer formation was applied to the circumference of the washed conductive support [1] by an immersion application method, and dried for 120° C. to form an interlayer [1] of 1.5 μm in dried film thickness.

[Chemical Formula 11]

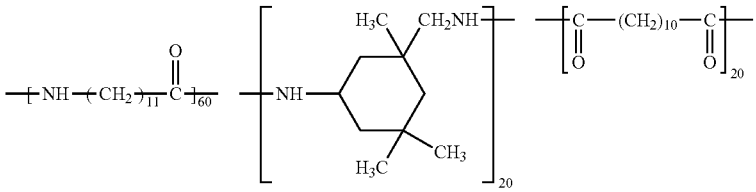

Polyamide Resin N-1

(Formation of Charge Generation Layer)

Charge Generation Substance: 20 parts of the following pigment (CG-1); Binder Resin: 10 parts of polyvinyl butyral resin "#6000-C (DENKIKAGAKUKOGYOKABUSHIKIKAISHA)"; Solvent: 700 parts of t-butyl acetate; and Solvent: 300 parts of 4-methoxy-4-methyl-2-pentanone were mixed, and dispersed for 10 hours with the use of a sand mill to form an application liquid [1] for charge generation layer formation. This application liquid [1] for charge generation layer formation was applied by an immersion coating method onto the interlayer [1] to form a charge generation layer [1] of 0.3 μm in dried film thickness.

<Synthesis of Pigment (CG-1)>

(1) Synthesis of Amorphous Titanyl Phthalocyanine

In 200 parts of o-dichlorobenzene, 29.2 parts of 1,3-diiminoisoindoline was dispersed, and heated for 5 hours at 150° C. to 160° C. under a nitrogen atmosphere with the addition of 20.4 parts of titanium tetra-n-butoxide. After cooling, the precipitated crystal was filtered, washed with chloroform, washed with a 2% hydrochloric acid aqueous solution, washed with water, washed with methanol, and died to obtain 26.2 parts (yield: 91%) of crude titanyl phthalocyanine.

Then, the crude titanyl phthalocyanine was dissolved by stirring for 1 hour in 250 parts of concentrated sulfuric acid at 5° C. or lower, and poured into 5000 parts of water at 20° C. The precipitated crystal was filtered, and sufficiently washed with water to obtain 225 parts of wet paste product.

This wet paste product was frozen in a freezer, again thawed, and then filtered and dried to obtain 24.8 parts (yield: 86%) of amorphous titanyl phthalocyanine.

(2) Synthesis of (2R,3R)-2,3-butanediol Adduct Titanyl Phthalocyanine (CG-1)

In 200 parts of orthochlorobenzene (ODB), 10.0 parts of the amorphous titanyl phthalocyanine and 0.94 parts (equivalent ratio 0.6) (the equivalent ratio refers to an equivalent ratio to the titanyl phthalocyanine) of (2R,3R)-2,3-butanediol were mixed, and heated and stirred for 6.0 hours at 60° C. to 70° C. After leaving overnight, methanol was added to the reaction liquid, the produced crystal was filtered, and the filtered crystal was washed with methanol to 10.3 parts of CG-1 (pigment containing (2R,3R)-2,3-butanediol adduct titanyl phthalocyanine). In an X-ray diffraction spectrum for the pigment (CG-1), there are cleat peaks at 8.3°, 24.7°, 25.1°, and 26.5°. In amass spectrum, there are peaks at 576 and 648, and in an IR spectrum, adsorption of both Ti═O and O—Ti—O appear around 970 $cm^{-1}$ and around 630 $cm^{-1}$. Furthermore, in a thermal analysis (TG), there is a mass decrease of about 7% at 390° C. to 410° C. Thus, presumed is a mixture of: 1:1 adduct of titanyl phthalocyanine and (2R,3R)-2,3-butanediol; and non-adduct (no addition) titanyl phthalocyanine.

The BET specific surface area of the obtained pigment (CG-1) was measured by a fluid specific surface area automatic measurement system (Micrometrics FlowSorb: Shimadzu Corporation) to result in 31.2 $m^2/g$ (Formation of Charge Transport Layer)

Charge Transport Substance: 225 parts of the following compound A; Binder Resin: 300 parts of polycarbonate resin "Z300" (from MITSUBISHI GAS CHEMICAL COMPANY, INC.); Antioxidant: 6 parts of "Irganox 1010" (from Nihon Ciba-Geigy K.K.); Solvent: 1600 parts of THF (tetrahydrofurane); Solvent: 400 parts of toluene; and 1 part of silicone oil "KF-50" (from Shin-Etsu Chemical Co., Ltd.) were mixed and dissolved to prepare an application liquid [1] for charge transport layer formation.

This application liquid [1] for charge transport layer formation was applied onto the charge generation layer [1] with the use of a circular slide hopper coating applicator to form a charge transport layer [1] of 20 μm in dried film thickness.

[Chemical Formula 12]

Compound A

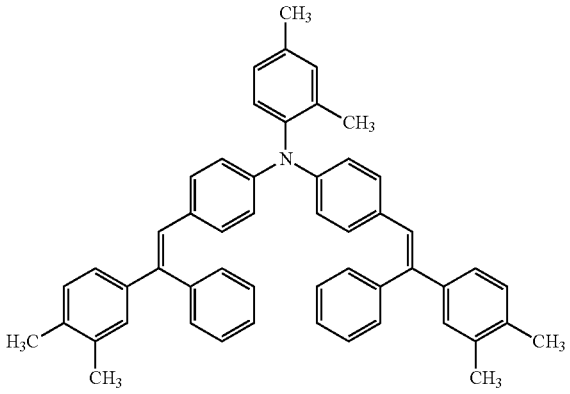

(Formation of Protective Layer)

(1) Preparation of Metal Oxide Microparticles

With the use of the following tin oxide [1] as untreated metal oxide microparticles, with the use of the exemplary compound (S-15) as a surface preparation agent, surface treatment was carried out as described below to prepare metal oxide microparticles [1].

The tin oxide [1] is 20 nm in primary particle size from CIK NanoTek Corporation.

First, a mixed solution of: 100 parts of the tin oxide [1]; 30 parts of the surface preparation agent (exemplary compound (S-15): $CH_2{=}C(CH_3)COO(CH_2)_3Si(OCH_3)_3$); and 300 parts of a mixed solvent of toluene/isopropyl alcohol=1/1 (mass ratio) was put in a sand mill along with zirconia beads, and stirred at a rotation speed of 1500 rpm at about 40° C. to carry out surface treatment. Furthermore, the treated mixture was taken out, put into a Henschel mixer, stirred for 15 minutes at a rotation speed of 1500 rpm, and then dried for 3 hours at 120° C. to terminate the surface treatment, thereby preparing the surface-treated tin oxide microparticles [1].

(2) Formation of Protective Layer

Metal Oxide Microparticles: 110 parts of tin oxide microparticles [1]; Polymerizable Compound: 100 parts of the exemplary compound (M1); Charge Transport Substance: 15 parts of the exemplary compound (CTM-13); Polymerization Initiator: 5 parts of the exemplary compound (P2); Radical Scavenger: 5 parts of "Sumilizer GS (in the general formula (2), $R_5$ is a tert-pentyl group, $R_6$ is a tert-pentyl group, and $R_7$ is a methyl group)" (from Sumitomo Chemical Co., Ltd.); Solvent: 320 parts of 2-butanol; and Solvent: 80 parts of tetrahydrofurane were mixed and stirred, and sufficiently dissolved or dispersed to prepare an application liquid [3] for protective layer formation. This application liquid [3] for protective layer formation was applied onto the charge transport layer [1] with the use of a circular slide hopper coating applicator to form a coating film, and the coating film was irradiated with ultraviolet rays for 1 minute with the use of a metal halide lamp to form a protective layer of 3.0 μm in dried film thickness, thereby preparing a photoreceptor [1].

[Preparation Examples 2 to 15 of Photoreceptors]

Photoreceptors [2] to [15] were prepared in the same way, except that the additive amounts of the polymerizable compound, radical scavenger, metal oxide microparticles, and charge transport substance used were changed in accordance with Table 1 in the formation of the protective layer in the preparation example 1 of the photoreceptor.

TABLE 1

| Photoreceptor No. | Additive Amount (parts by mass) | | | | |
|---|---|---|---|---|---|
| | Polymerizable Compound | Radical Scavenger | Polymerization Initiator | Charge Transport Substance | Metal Oxide Microparticle |
| [1] | 100 | 5 | 5 | 15 | 110 |
| [2] | 100 | 5 | 5 | 15 | 140 |
| [3] | 97 | 8 | 5 | 10 | 200 |
| [4] | 97 | 8 | 5 | 10 | 230 |
| [5] | 95 | 10 | 5 | 8 | 250 |
| [6] | 100 | 5 | 5 | 50 | 30 |
| [7] | 100 | 5 | 5 | 30 | 45 |
| [8] | 100 | 5 | 5 | 15 | 90 |
| [9] | 95 | 10 | 5 | 4 | 300 |
| [10] | 100 | 5 | 5 | 4 | 130 |
| [11] | 100 | 5 | 5 | 20 | 130 |
| [12] | 100 | 5 | 5 | 30 | 130 |
| [13] | 97 | 0 | 5 | 10 | 200 |
| [14] | 97 | 8 | 5 | 5 | 200 |
| [15] | 97 | 8 | 5 | 15 | 200 |

Table 2 below shows, in terms of parts by volume, the additive amounts of the respective constituents shown in Table 1. In addition, Table 2 shows the volume ratio A (volume %) of the metal oxide microparticles in the protective layer and the volume ratio B (volume %) of the charge transport substance in the protective layer.

It is to be noted that the conversion was achieved when the specific gravity of the organic substance was regarded as 1.1, whereas the specific gravity of the metal oxide microparticles (tin oxide) was regarded as 6.9. In addition, the values listed in Table 2 are rounded off to the closest whole numbers.

TABLE 2

| Photoreceptor No. | Additive Amount (parts by volume) | | | | | | Volume Ratio A of Metal Oxide Microparticle (Volume %) | Volume Ratio B of Charge Transport Substance (Volume %) | 80/A | 160/A |
|---|---|---|---|---|---|---|---|---|---|---|
| | Polymerizable Compound | Radical Scavenger | Polymerization Initiator | Charge Transport Substance | Metal Oxide Microparticle | Total | | | | |
| [1] | 91 | 5 | 5 | 14 | 16 | 129 | 12 | 11 | 7 | 13 |
| [2] | 91 | 5 | 5 | 14 | 20 | 134 | 15 | 10 | 5 | 11 |
| [3] | 88 | 7 | 5 | 9 | 29 | 138 | 21 | 7 | 4 | 8 |
| [4] | 88 | 7 | 5 | 9 | 33 | 142 | 23 | 6 | 3 | 7 |
| [5] | 88 | 9 | 5 | 7 | 36 | 143 | 25 | 5 | 3 | 6 |

TABLE 2-continued

| Photoreceptor No. | Additive Amount (parts by volume) Polymerizable Compound | Radical Scavenger | Polymerization Initiator | Charge Transport Substance | Metal Oxide Microparticle | Total | Volume Ratio A of Metal Oxide Microparticle (Volume %) | Volume Ratio B of Charge Transport Substance (Volume %) | 80/A | 160/A |
|---|---|---|---|---|---|---|---|---|---|---|
| [6] | 91 | 5 | 5 | 45 | 4 | 150 | 3 | 30 | 28 | 56 |
| [7] | 91 | 5 | 5 | 27 | 6 | 134 | 5 | 20 | 17 | 33 |
| [8] | 91 | 5 | 5 | 14 | 13 | 127 | 10 | 11 | 8 | 16 |
| [9] | 86 | 9 | 5 | 4 | 43 | 147 | 29 | 2 | 3 | 5 |
| [10] | 91 | 5 | 5 | 4 | 19 | 122 | 15 | 3 | 5 | 10 |
| [11] | 91 | 5 | 5 | 18 | 19 | 137 | 14 | 13 | 6 | 12 |
| [12] | 91 | 5 | 5 | 27 | 19 | 146 | 13 | 19 | 6 | 12 |
| [13] | 88 | 0 | 5 | 9 | 29 | 131 | 22 | 7 | 4 | 7 |
| [14] | 88 | 7 | 5 | 5 | 29 | 133 | 22 | 3 | 4 | 7 |
| [15] | 88 | 7 | 5 | 14 | 29 | 142 | 20 | 10 | 4 | 8 |

Examples 1 to 5 and Comparative Examples 1 to 10

With the use of, as an evaluation machine, "bizhub PRESS C8000" from KONICA MINOLTA, INC., basically configured as shown in FIG. 3, the photoreceptors [1] to [15] were each mounted on the evaluation machine to make evaluations.

A durability test was carried out in which a text image with an image ratio of 6% was printed continuously onto both sides of 300,000 sheets through transverse feed of size A4. After the durability test, the photoreceptors were evaluated on image characteristics.

(1) Scratch Resistance

After the durability test, under an environment at a temperature 10° C. and humidity of 20% RH, an internally loaded pattern No. 53/Dot 1 (typical exposure pattern formed on regular dots) was printed with a concentration indicating value of 100 onto "POD gloss coated paper (100 g/m$^2$)" (from Oji Paper Co., Ltd.) in size A3 to visually observe the generation of white lines on the half tone image due to the damaged surface of the photoreceptor.

—Evaluation Criteria—

A: No White Line Generated (OK)

B: White Line Lightly Generated (NG)

C: White Line Generated (NG)

(2) Transfer Memory

After the durability test, under an environment at a temperature of 30° C. and humidity of 80% RH, an image with a solid image obtained by the first rotation of the photoreceptor and a half-tone image obtained by the second rotation of the photoreceptor was printed onto "POD gloss coated paper (100 g/m$^2$)" (from Oji Paper Co., Ltd.) in a size A3 to visually observe whether or not the first-rotation solid image appears as a memory on the second-rotation half tone image. In addition, the memory was evaluated when the second charging unit (neutralization unit) mounted on the "bizhub PRESS C8000" was operated, and when the unit was not operated.

—Evaluation Criteria—

A: No Memory Generation (OK)

B: Minor Memory Confirmed (OK)

C: Memory Confirmed (NG)

D: Clear Memory Confirmed (NG)

(3) Dot Reproducibility

After the durability test, under an environment at a temperature 30° C. and humidity of 80% RH, an internally loaded pattern No. 53/Dot 1 (typical exposure pattern formed on regular dots) was printed with a concentration indicating value of 100 onto "POD gloss coated paper (100 g/m$^2$)" (from Oji Paper Co., Ltd.) in size A3 to visually observe the formation of dots at a magnification.

—Evaluation Criteria—

A: Dot Properly Formed (OK)

B: Thin Dot (NG)

C: NO Dot Formed (NG)

TABLE 3

| | Photoreceptor No. | Scratch Resistance | Transfer Memory With Neutralization Unit | Transfer Memory Without Neutralization Unit | Dot Reproducibility |
|---|---|---|---|---|---|
| Example 1 | Photoreceptor[1] | A | A | A | A |
| Example 2 | Photoreceptor[2] | A | A | A | A |
| Example 3 | Photoreceptor[3] | A | A | A | A |
| Example 4 | Photoreceptor[4] | A | A | B | A |
| Example 5 | Photoreceptor[5] | A | A | B | A |
| Comparative Example 1 | Photoreceptor[6] | C | A | A | A |
| Comparative Example 2 | Photoreceptor[7] | C | A | A | A |
| Comparative Example 3 | Photoreceptor[8] | B | A | A | A |
| Comparative Example 4 | Photoreceptor[9] | A | C | C | C |
| Comparative Example 5 | Photoreceptor[10] | A | C | D | C |

TABLE 3-continued

| | Photoreceptor No. | Scratch Resistance | Transfer Memory: With Neutralization Unit | Transfer Memory: Without Neutralization Unit | Dot Reproducibility |
|---|---|---|---|---|---|
| Comparative Example 6 | Photoreceptor[11] | B | A | A | B |
| Comparative Example 7 | Photoreceptor[12] | C | A | A | C |
| Comparative Example 8 | Photoreceptor[13] | A | A | A | C |
| Comparative Example 9 | Photoreceptor[14] | A | A | C | C |
| Comparative Example 10 | Photoreceptor[15] | B | A | A | C |

From the results in Table 3, it has been confirmed that in Examples 1 to 5 according to the present invention, the protective layer contains: the cured resin constituent obtained by polymerizing the polymerizable compound in the presence of the specific radical scavenger; the metal oxide microparticles; and the specific charge transport substance, and the mixing ratios (volume ratios) of the metal oxide microparticles and specific charge transport substance satisfy the relational expression (1) and the relational expression (2). Thus, even after use over a long period of time, the generation of transfer memory is suppressed with scratch resistance, and images with excellent dot reproducibility can be formed. In addition, it has been confirmed that the generation of transfer memory can be more certainly suppressed in the case of operating the neutralization unit.

On the other hand, it has been confirmed that in Comparative Examples 1 to 3, the protective layer fails to have sufficient scratch resistance, because the volume ratio A of the metal oxide microparticles is excessively low (fails to satisfy the relational expression (2)).

It has been confirmed that in Comparative Example 4, the dot reproducibility is decreased, because the volume ratio A of the metal oxide microparticles is excessively high (fails to satisfy the relational expression (2)). This is believed to be because the electric field intensity of the protective layer is decreased by the excessive amount of metal oxide microparticles. Furthermore, it has been confirmed that the generation of transfer memory is not able to be suppressed certainly, because the volume ratio B of the charge transport substance is excessively low (fails to satisfy the relational expression (1)).

In Comparative Example 5, it has been confirmed that the generation of transfer memory is not able to be suppressed certainly, with the dot reproducibility decreased, because the volume ratio B of the charge transport substance is excessively low (fails to satisfy the relational expression (1)).

In Comparative Examples 6 and 7, it has been confirmed that scratch resistance is insufficiently achieved, with the dot reproducibility decreased, because the volume ratio B of the charge transport substance is excessively high (fails to satisfy the relational expression (1)). It is to be noted that it is believed that in Comparative Examples 6 and 7, because of the excessively high volume ratio B of the charge transport substance, the charge transport substance develops the function as a plasticizer, thereby resulting in failure to sufficiently achieve the film strength of the protective layer, and thus decreasing the scratch resistance.

In Comparative Example 8, it has been confirmed that the dot reproducibility is decreased because the radical scavenger is not added. It is believed that in Comparative Example 8, because the radical scavenger is not added, the protective layer is adapted to have excessive abrasion resistance, but not moderately provided with wear or tear by the cleaning unit, thereby decreasing the dot reproducibility due to the deposition discharge products, etc.

In Comparative Example 9, it has been confirmed that the generation of transfer memory is not able to be suppressed certainly, with the dot reproducibility decreased, because the volume ratio B of the charge transport substance is excessively low (fails to satisfy the relational expression (1)).

In Comparative Example 10, it has been confirmed that scratch resistance is insufficiently achieved, with the dot reproducibility decreased, because the volume ratio B of the charge transport substance is excessively high (fails to satisfy the relational expression (1)).

Although the present invention has been described and illustrated in detail, it is clearly understood that the same is by way of illustrated and example only and is not to be taken by way of limitation, the scope of the present invention being interpreted by terms of the appended claims.

What is claimed is:

1. An organic photoreceptor comprising:

a conductive support;

an organic photosensitive layer formed on the conductive support; and a protective layer formed on the organic photosensitive layer, wherein the protective layer contains: a cured resin constituent obtained by polymerizing a polymerizable compound in the presence of a radical scavenger represented by the following general formula (2); metal oxide microparticles; and a compound represented by the following general formula (1) as a charge transport substance, the polymerizable compound has two or more acryloyl groups ($CH_2{=}CHCO{-}$) or methacryloyl groups ($CH_2{=}CCH_3CO{-}$), and the following relational expression (1) and the following relational expression (2) are satisfied when the volume ratio (volume %) of the metal oxide microparticles in the protective layer and the volume ratio (volume %) of the compound represented by the general formula (1) in the protective layer are respectively denoted by A and B, Relational Expression (1): $80/A \leq B \leq 160/A$ Relational Expression (2): $12 \leq A \leq 25$ General Formula (1)

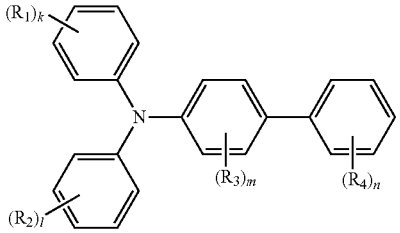

in the general formula (1), $R_1$, $R_2$, $R_3$, and $R_4$ each represents a hydrogen atom, an alkyl group having 1 to 7 carbon atoms, and an alkoxy group having 1 to 7 carbon atoms, k, l, and n each represents an integer of 1 to 5, and m represents an integer of 1 to 4, provided that when k, l, n, or m is 2 or more, multiple $R_1$, $R_2$, $R_3$ and $R_4$ may be identical to each other, or different from each other General Formula (2)

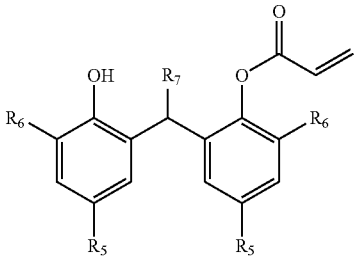

in the general formula (2), $R_5$ and $R_6$ each represents an alkyl group having 1 to 6 carbon atoms, and $R_7$ represents a hydrogen atom or a methyl group.

2. The organic photoreceptor according to claim 1, wherein in the general formula (1), $R_1$ and $R_2$ are each a hydrogen atom or a methyl group, $R_3$ is a hydrogen atom, $R_4$ is an alkyl group having 1 to 5 carbon atoms, and k, l, m, and n are each 1.

3. The organic photoreceptor according to claim 1, wherein in the general formula (2), $R_5$ and $R_6$ are a tert-butyl group or a tert-pentyl group.

4. The organic photoreceptor according to claim 1, wherein in the general formula (2), $R_7$ is a methyl group.

5. The organic photoreceptor according to claim 1, wherein the metal oxide microparticles comprise tin oxide.

6. The organic photoreceptor according to claim 1, wherein the tin oxide is 3 nm to 100 nm in number average primary particle size.

7. The organic photoreceptor according to claim 1, wherein the charge transport substance represented by the general formula (1) has a molecular weight of 320 or more and 420 or less.

8. The organic photoreceptor according to claim 1, wherein the metal oxide microparticles has a volume ratio A of 12 volume % or more and 21 volume % or less.

9. The organic photoreceptor according to claim 1, wherein in the general formula (1), the alkyl group having 1 to 7 carbon atoms is a methyl group, an ethyl group, a propyl group, an n-butyl group, or an n-pentyl group.

10. The organic photoreceptor according to claim 1, wherein in the general formula (1), the alkoxy group having 1 to 7 carbon atoms is a methoxy group.

11. The organic photoreceptor according to claim 1, wherein in the general formula (1), at least one of $R_1$, $R_2$, $R_3$, and $R_4$ is a propyl group, a butyl group, or a pentyl group.

12. The organic photoreceptor according to claim 1, wherein the radical scavenger represented by the general formula (2) is added in a proportion of 1 to 30 parts by mass with respect to 100 parts by mass of the polymerizable compound.

13. The organic photoreceptor according to claim 1, wherein the protective layer is applied with a circular slide hopper coating applicator.

14. An image forming apparatus comprising:

an organic photoreceptor;

a first charging unit for charging the surface of the organic photoreceptor;

an exposure unit for irradiating the surface of the organic photoreceptor with light to form an electrostatic latent image;

a development unit for developing the electrostatic latent image with a toner to form a toner image;

a transfer unit for transferring the toner image to a transfer material;

a second charging unit for charging the surface of the organic photoreceptor after transferring the toner image to the transfer material; and a cleaning unit for removing a residual toner on the organic photoreceptor, wherein the organic photoreceptor is the organic photoreceptor according to claim 1.

15. An image forming method wherein the image forming apparatus according to claim 14 is used for image formation.

* * * * *